US011364727B2

(12) United States Patent
Takahashi et al.

(10) Patent No.: US 11,364,727 B2
(45) **Date of Patent: *Jun. 21, 2022**

(54) DRAWING AND ERASING APPARATUS AND ERASING METHOD

(71) Applicant: Sony Corporation, Tokyo (JP)

(72) Inventors: Isao Takahashi, Tokyo (JP); Nobukazu Hirai, Tokyo (JP); Satoko Asaoka, Tokyo (JP); Mitsunari Hoshi, Tokyo (JP); Taichi Takeuchi, Tokyo (JP); Eikichi Shibata, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/252,496

(22) PCT Filed: Jun. 6, 2019

(86) PCT No.: PCT/JP2019/022474
§ 371 (c)(1),
(2) Date: Dec. 15, 2020

(87) PCT Pub. No.: WO2019/244649
PCT Pub. Date: Dec. 26, 2019

(65) Prior Publication Data

US 2021/0187965 A1 Jun. 24, 2021

(30) Foreign Application Priority Data

Jun. 22, 2018 (JP) ..... JP2018-118966

(51) Int. Cl.
*B41J 2/475* (2006.01)
*B41J 2/44* (2006.01)
(Continued)

(52) U.S. Cl.
CPC ..... *B41J 2/442* (2013.01); *B41J 2/475* (2013.01); *B41M 5/28* (2013.01); *B41M 5/34* (2013.01)

(58) Field of Classification Search
CPC .. B41J 2002/4756; B41J 2/4753; B41J 2/442; B41M 5/34; B41M 5/28; B41M 5/305; B41M 5/323
See application file for complete search history.

(56) References Cited

U.S. PATENT DOCUMENTS 9,162,480 B2 10/2015 Ishimi et al.
9,724,951 B2 8/2017 Ishimi et al.
(Continued)

FOREIGN PATENT DOCUMENTS

JP 2004-249540 A 9/2004
JP 2004249541 A * 9/2004 ..... B41J 2/471
(Continued)

OTHER PUBLICATIONS

International Search Report issued in International Patent Application No. PCT/JP2019/022474 dated Jul. 16, 2019 and English translation of same. 5 pages.
(Continued)

*Primary Examiner* — Matthew Luu
*Assistant Examiner* — Kendrick X Liu
(74) *Attorney, Agent, or Firm* — K&L Gates LLP

(57) ABSTRACT

A drawing and erasing apparatus includes a light source section that includes a plurality of laser elements different from each other in emission wavelength, a multiplexer that multiplexes a plurality of types of laser light beams outputted from the plurality of laser elements, a scanner section that performs scanning with multiplexed light outputted from the multiplexer on a reversible recording medium including a plurality of recording layers, the plurality of
(Continued)

recording layers being reversible and different from each other in developed color hue, and a controller that controls a main scanning speed and a sub-scanning speed of the scanner section to cause the scanner section to perform overlapping scanning of a predetermined region on the reversible recording medium during erasure of information written on the reversible recording medium.

16 Claims, 13 Drawing Sheets

(51) Int. Cl.

| | |
|---|---|
| ***B41M 5/34*** | (2006.01) |
| ***B41M 5/28*** | (2006.01) |
| ***B41M 5/30*** | (2006.01) |
| ***B41M 5/323*** | (2006.01) |

(56) References Cited

U.S. PATENT DOCUMENTS

| | | | | |
|---|---|---|---|---|
| 10,165,942 | B2 | 1/2019 | Uji et al. | |
| 2011/0267416 | A1 | 11/2011 | Yohn et al. | |
| 2012/0212564 | A1 * | 8/2012 | Yamamoto | B41J 2/4753 347/225 |
| 2014/0285606 | A1 | 9/2014 | Ishimi et al. | |
| 2016/0271991 | A1 | 9/2016 | Ishimi et al. | |

FOREIGN PATENT DOCUMENTS

| | | | | |
|---|---|---|---|---|
| JP | 2009-172801 | A | 8/2009 | |
| JP | 2011-212432 | A | 10/2011 | |
| JP | 2012-037616 | A | 2/2012 | |
| JP | 2013-116598 | A | 6/2013 | |
| JP | 2016-127901 | A | 7/2016 | |
| JP | 2016-175406 | A | 10/2016 | |
| WO | WO-2013084903 | A1 * | 6/2013 | B41J 2/32 |

OTHER PUBLICATIONS

Written Opinion issued in International Patent Application No. PCT/JP2019/022474 dated Jul. 16, 2019. 6 pages.

* cited by examiner

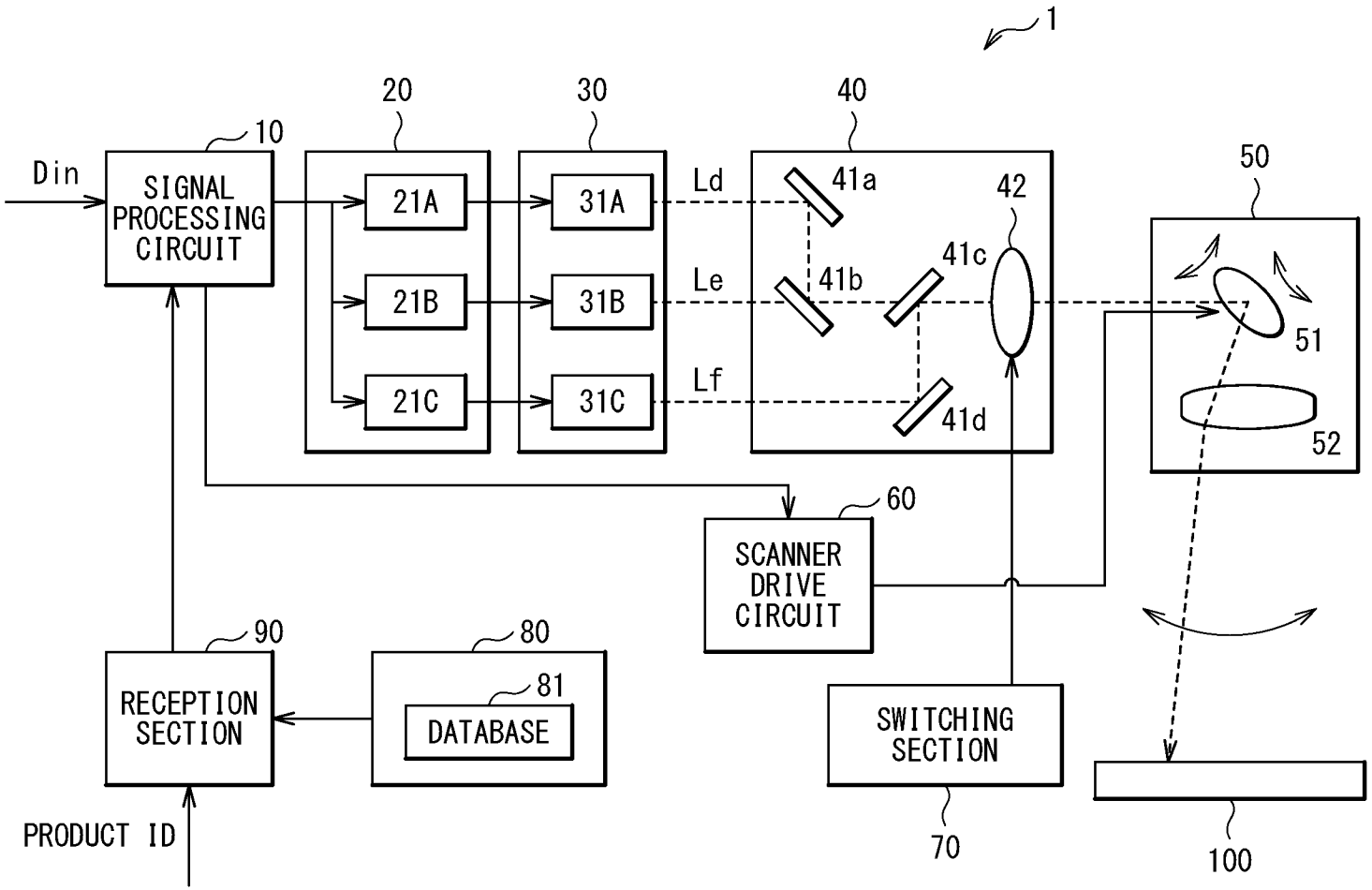
[ FIG. 1 ]

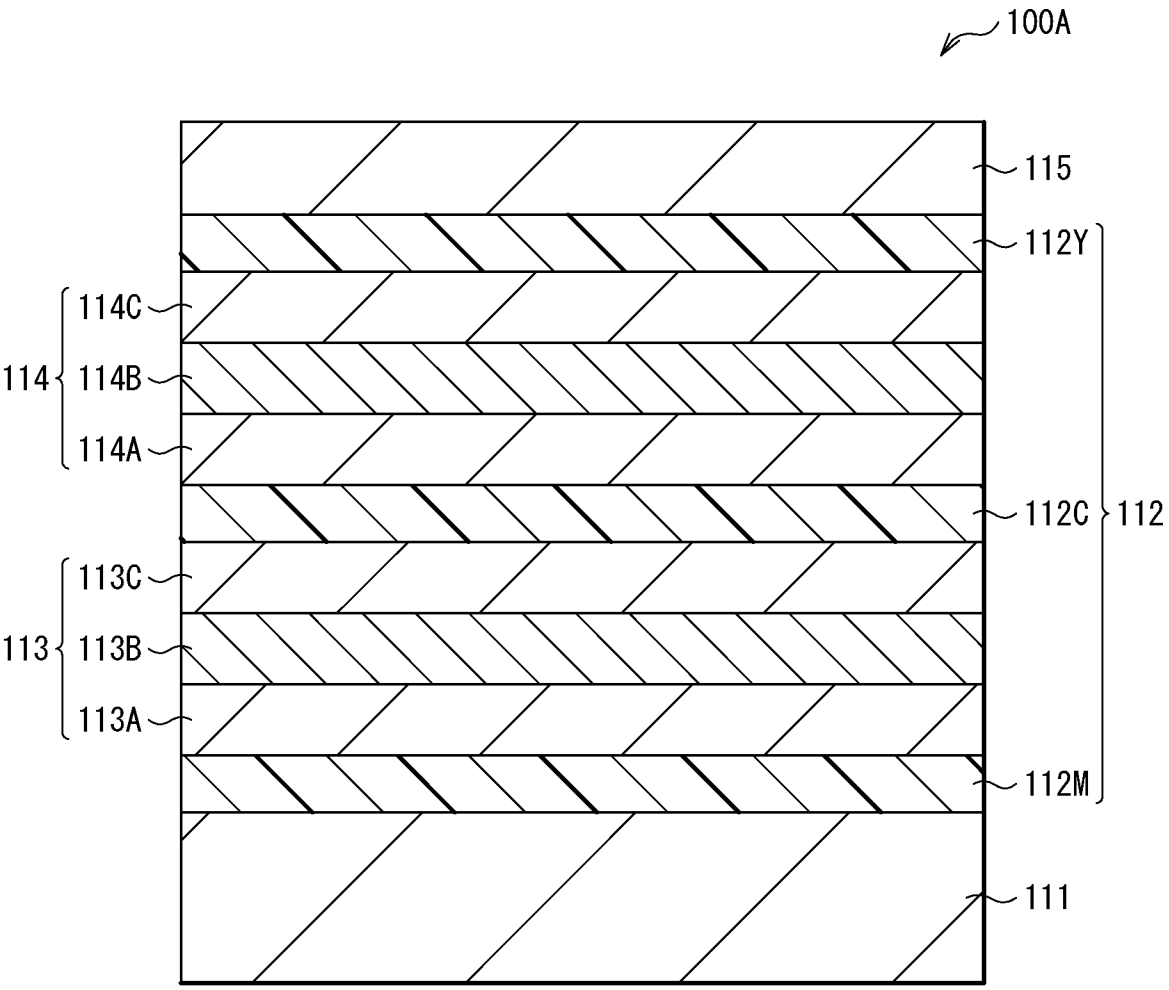
[ FIG. 2 ]

[ FIG. 3 ]
81
81A 81B
| PRODUCT ID | LASER ID | |
|---|---|---|
| 001 | 790 | 880 |
| 002 | 790 | 915 |
[ FIG. 4 ]
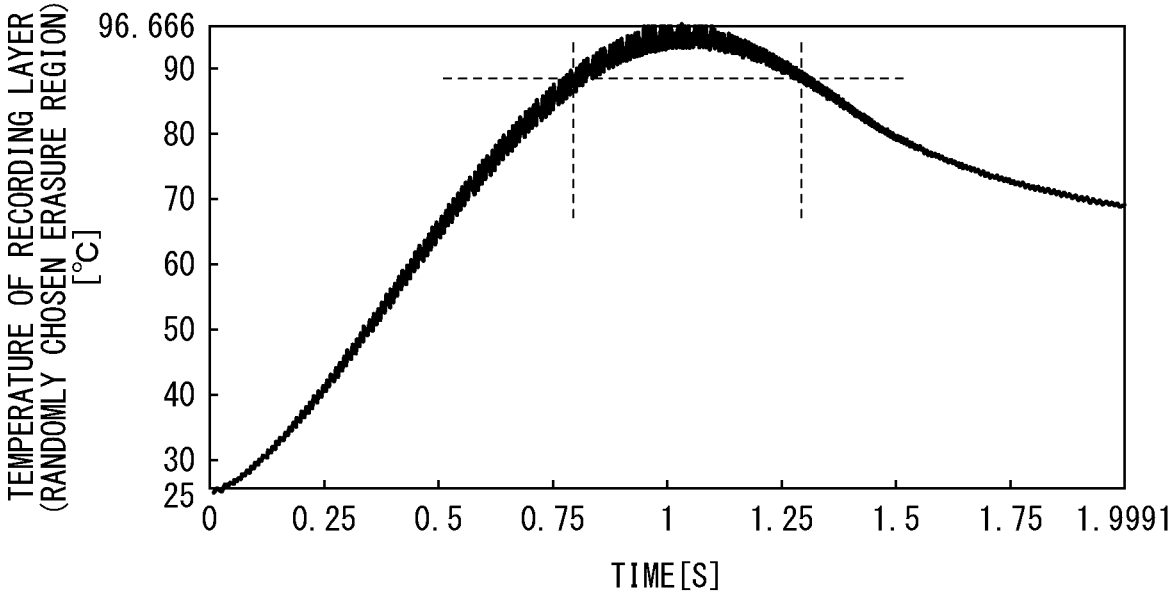

[ FIG. 5A ]
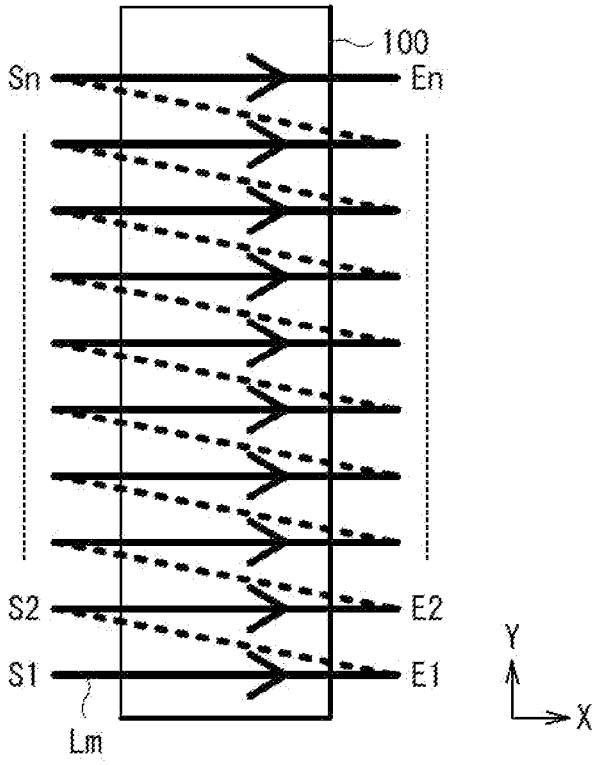
[ FIG. 5B ]
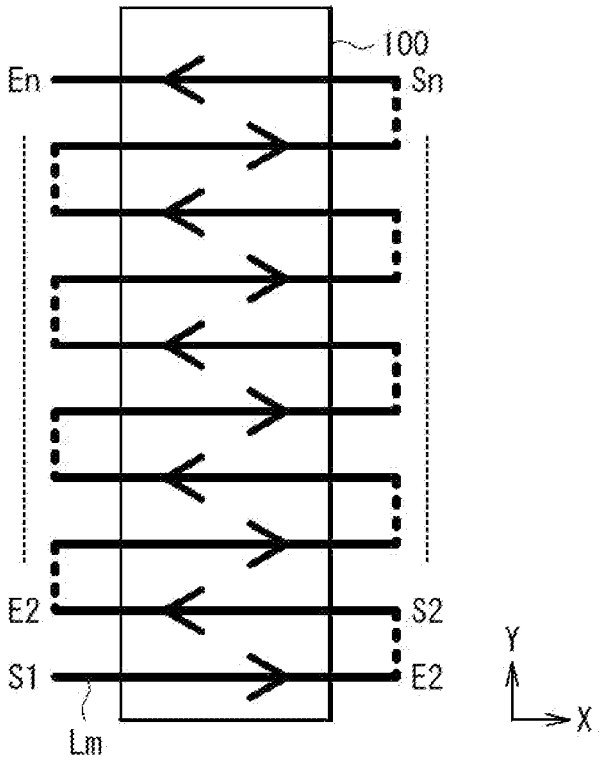

[ FIG. 5C ]
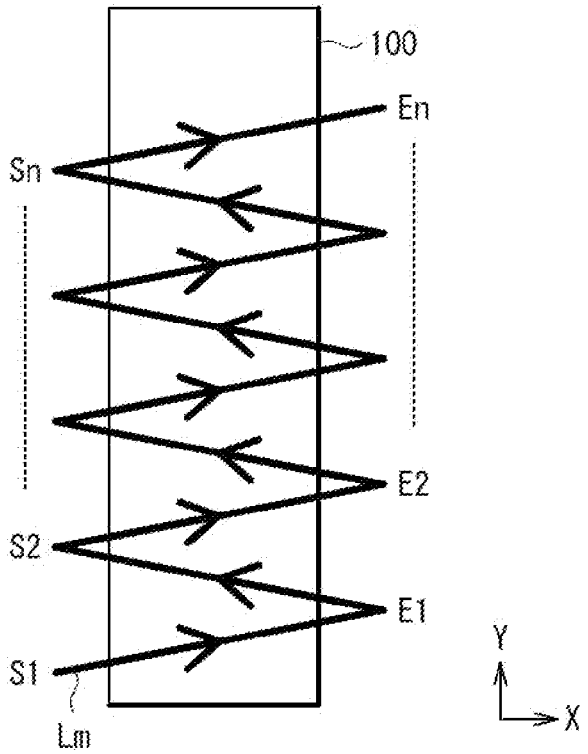

[ FIG. 6A ]
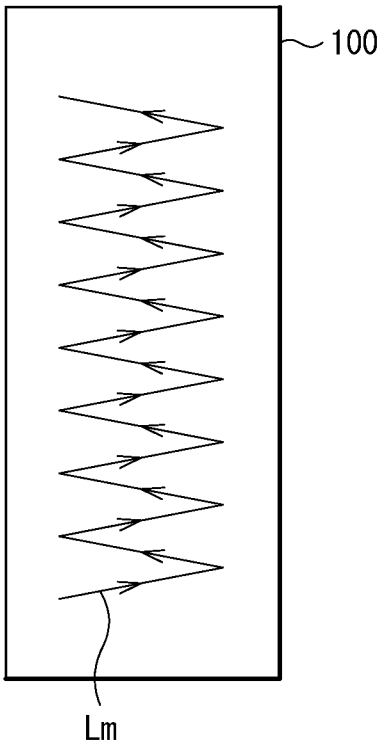
[ FIG. 6B ]
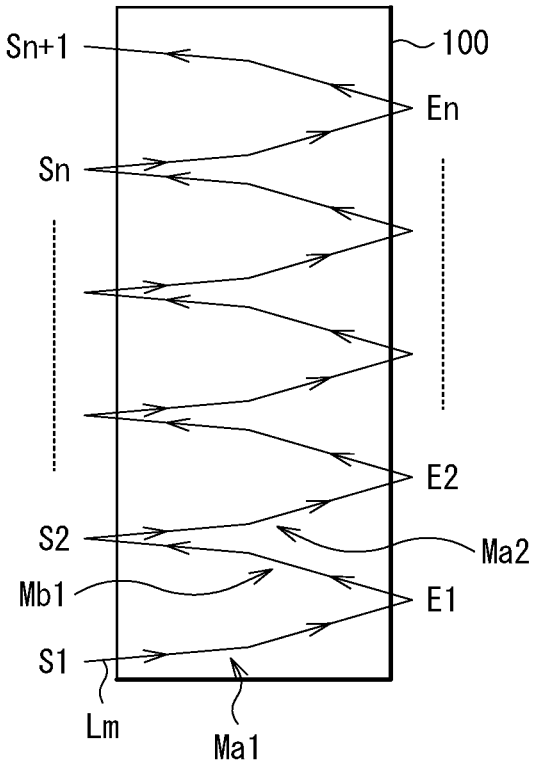

[ FIG. 7 ]
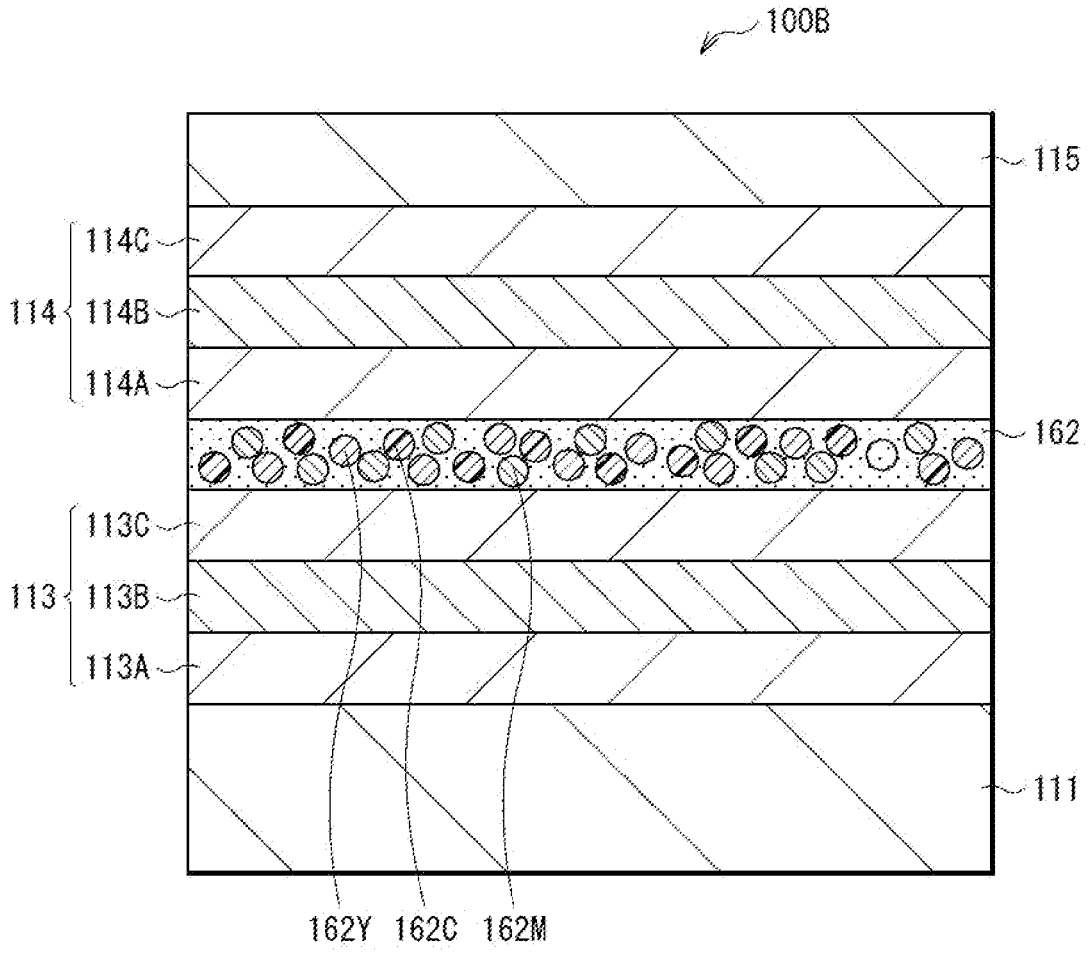

[ FIG. 8A ]
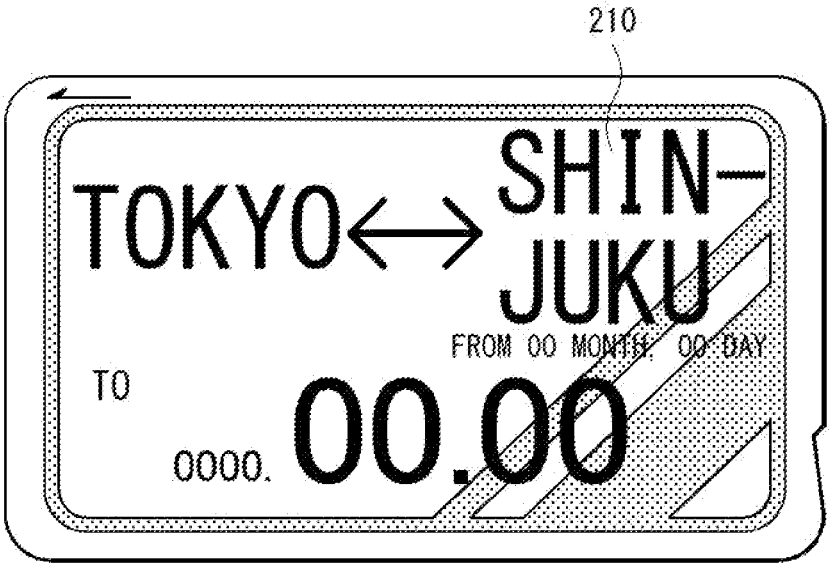
[ FIG. 8B ]
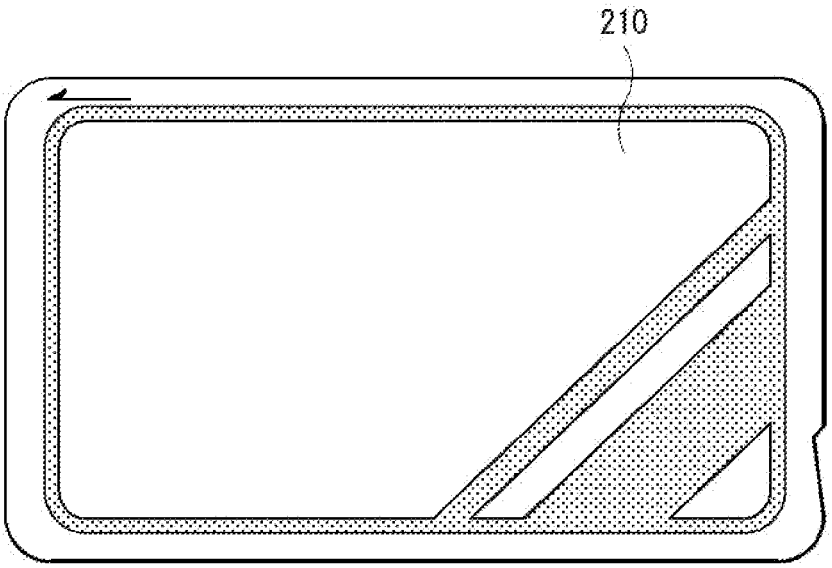

[ FIG. 9A ]
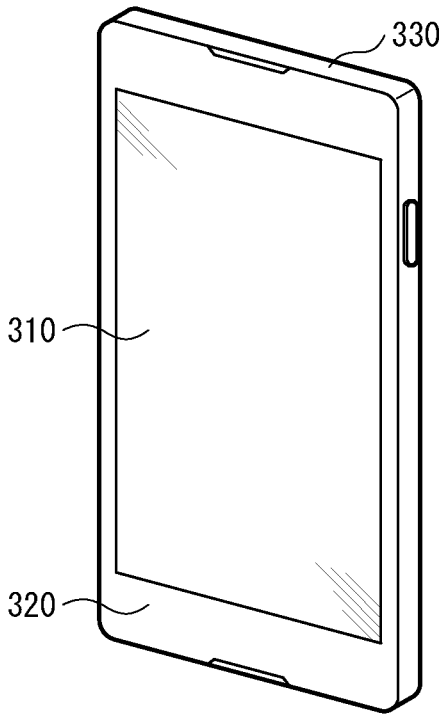
[ FIG. 9B ]
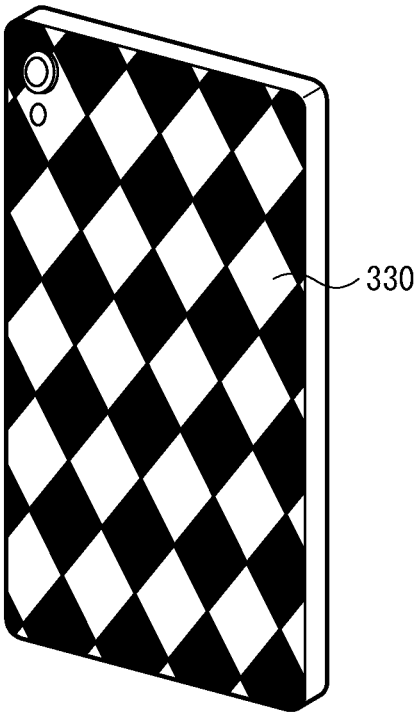

[ FIG. 10A ]
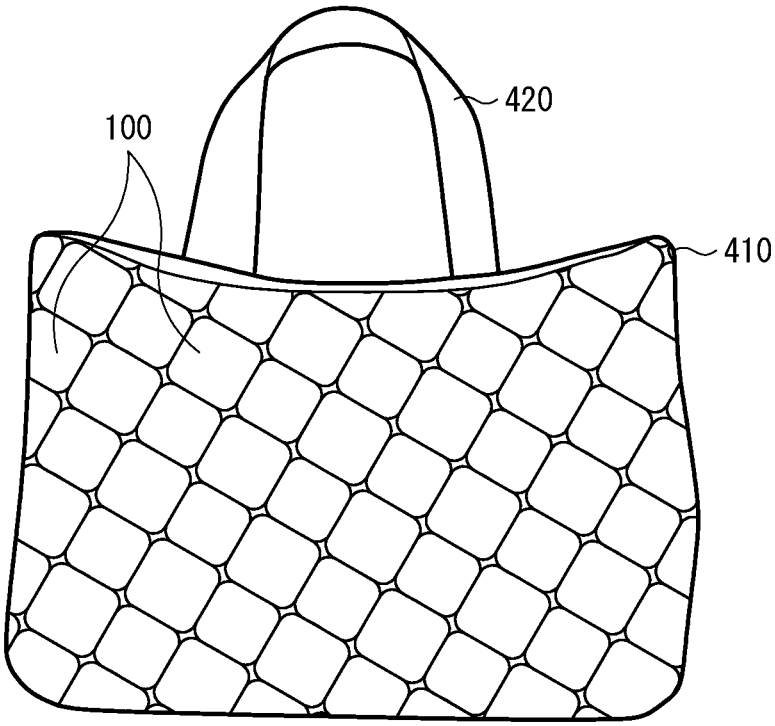
[ FIG. 10B ]
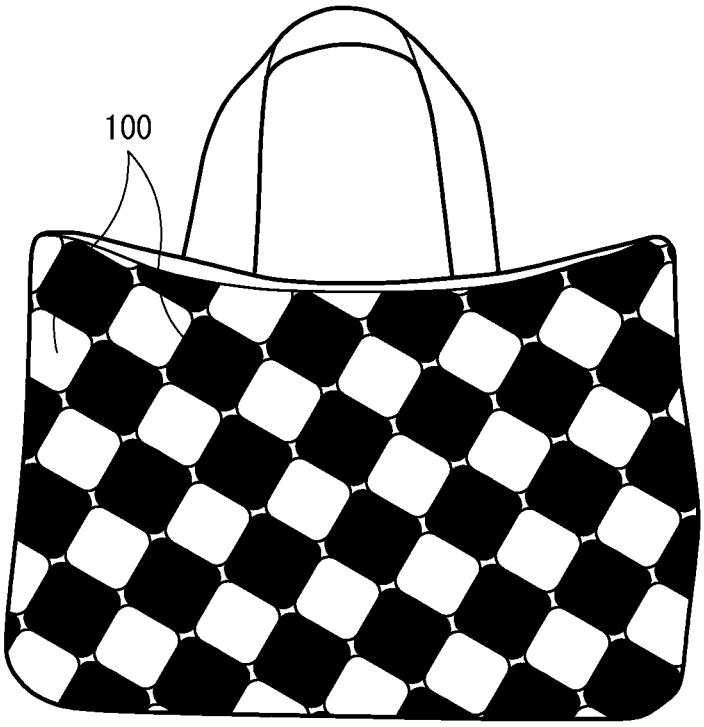

[ FIG. 11 ]
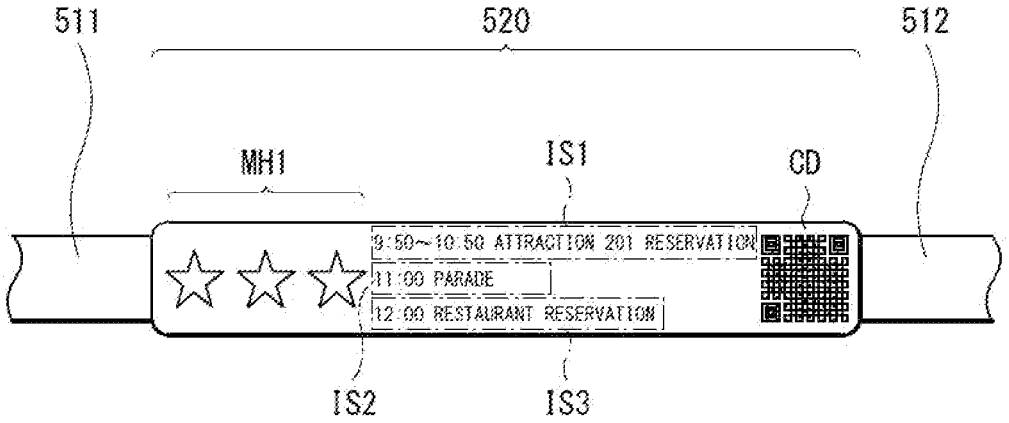

[ FIG. 12A ]
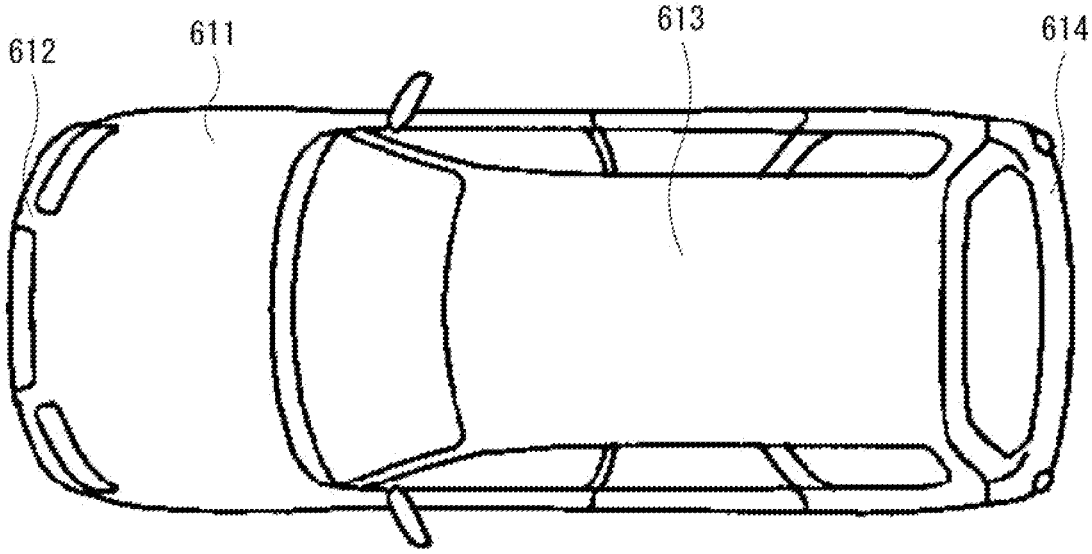
[ FIG. 12B ]
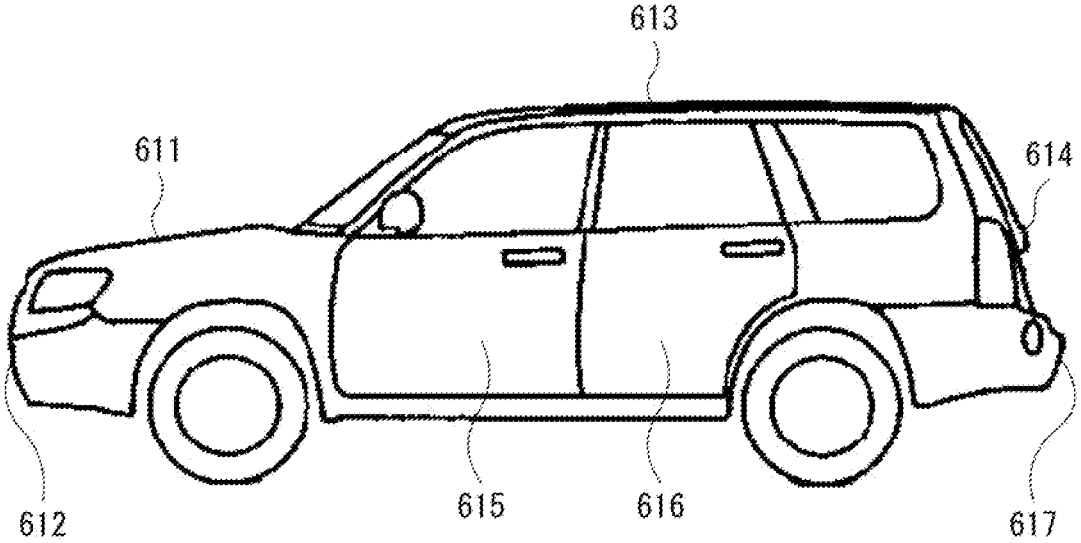

[ FIG. 13 ]
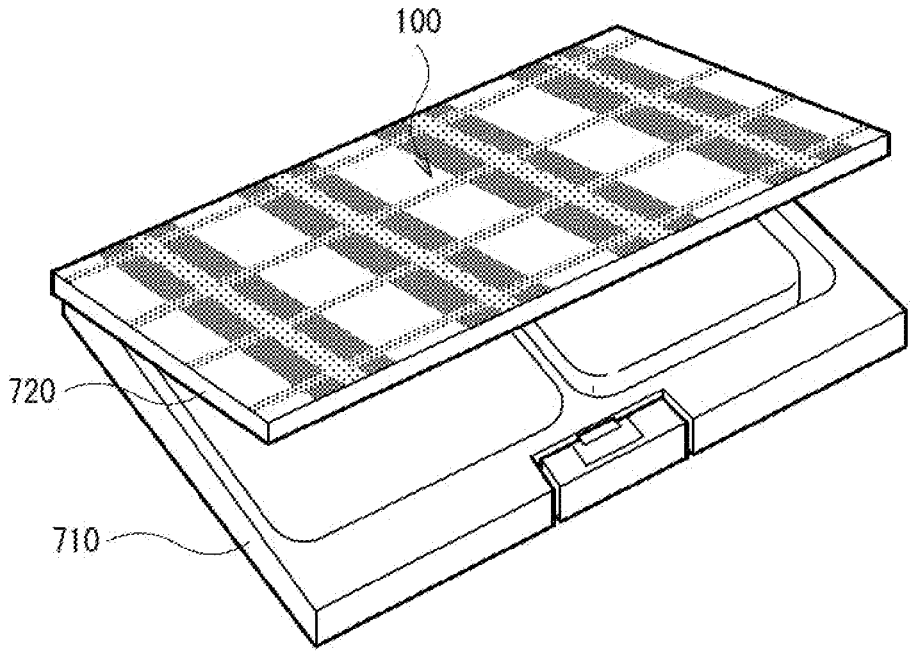

DRAWING AND ERASING APPARATUS AND ERASING METHOD

TECHNICAL FIELD

The present disclosure relates to a drawing and erasing apparatus and an erasing method for a reversible recording medium including a leuco dye, for example.

BACKGROUND ART

In recent years, the necessity of a rewritable recording technique has been recognized from the viewpoint of the global environment, and a thermal-system recording medium using, for example, a thermal color developing composition such as a leuco dye has become widespread. As such a recording medium, an irreversible recording medium which is not erasable after writing is performed once and a reversible recording medium which is rewritable many times have been put into practical use. On the reversible recording medium, for example, writing and erasure of information are performed with a drawing apparatus including a light source for writing and a light source for erasure. In addition, writing of information is performed with a writing apparatus including a light source for writing, and erasure of information is performed with an erasing apparatus including a light source for erasure.

As the erasing apparatus, for example, PTL 1 discloses an image erasing apparatus that makes it possible to uniformly erase an image recorded on a thermo-reversible recording medium by including, as a light source, an LD array that outputs a laser light beam having a line-shaped cross section, an optical system including a cylindrical lens that converts the laser light beam outputted from the LD array into converging light converging in a width direction and outputs the converging light, and a uniaxial galvanometer mirror that polarizes the laser light beam outputted from the optical system in the width direction to perform scanning therewith on the thermally reversible recording medium.

CITATION LIST

Patent Literature

PTL 1: Japanese Unexamined Patent Application Publication No. 2013-116598

SUMMARY OF THE INVENTION

Meanwhile, improvement in display quality is demanded of a reversible recording medium that enables multicolor display.

It is desirable to provide a drawing and erasing apparatus and an erasing method that make it possible to improve display quality.

A drawing and erasing apparatus of an embodiment of the present disclosure includes a light source section that includes a plurality of laser elements different from each other in emission wavelength, a multiplexer that multiplexes a plurality of types of laser light beams outputted from the plurality of laser elements, a scanner section that performs scanning with multiplexed light outputted from the multiplexer on a reversible recording medium including a plurality of recording layers, the plurality of recording layers being reversible and different from each other in developed color hue, and a controller that controls a main scanning speed and a sub-scanning speed of the scanner section to cause the scanner section to perform overlapping scanning of a predetermined region on the reversible recording medium during erasure of information written on the reversible recording medium.

An erasing method of an embodiment of the present disclosure includes multiplexing laser light beams outputted from a plurality of laser elements different from each other in emission wavelength, and performing, with multiplexed light, overlapping scanning of a predetermined region on a reversible recording medium including a plurality of recording layers, the plurality of recording layers being reversible and different from each other in developed color hue.

In the drawing and erasing apparatus of the embodiment of the present disclosure and the erasing method of the embodiment of the present disclosure, the light source section is configured using a plurality of laser elements different from each other in emission wavelength, and overlapping scanning of a predetermined region on the reversible recording medium is performed with multiplexed light obtained by multiplexing a plurality of types of laser light beams outputted from the plurality of laser elements. A temperature level of the predetermined region of the reversible recording medium is thereby finely adjusted.

According to the drawing and erasing apparatus of the embodiment of the present disclosure and the erasing method of the embodiment of the present disclosure, overlapping scanning is performed on a predetermined region on the reversible recording medium with multiplexed light obtained by multiplexing a plurality of types of laser light beams outputted from the plurality of laser elements different from each other in emission wavelength. This makes it possible to perform fine adjustments of the temperature level of the predetermined region. Consequently, erasure defects are reduced and it becomes possible to improve the display quality.

Note that the effects described here are not necessarily limiting, and may be any of effects described below.

BRIEF DESCRIPTION OF DRAWINGS

FIG. 1 illustrates a system configuration example of a drawing and erasing apparatus for a reversible recording medium according to an embodiment of the present disclosure.

FIG. 2 is a schematic cross-sectional diagram illustrating an example of a configuration of the reversible recording medium illustrated in FIG. 1.

FIG. 3 illustrates an example of a database illustrated in FIG. 1.

FIG. 4 illustrates a temperature profile in a randomly chosen region of a reversible recording medium in an erasure process using the drawing and erasing apparatus illustrated in FIG. 1.

FIG. 5A illustrates an example of a scanning path in the erasure process using the drawing and erasing apparatus illustrated in FIG. 1.

FIG. 5B illustrates another example of the scanning path in the erasure process using the drawing and erasing apparatus illustrated in FIG. 1.

FIG. 5C illustrates another example of the scanning path in the erasure process using the drawing and erasing apparatus illustrated in FIG. 1.

FIG. 6A illustrates another example of the scanning path in the erasure process using the drawing and erasing apparatus illustrated in FIG. 1.

FIG. 6B illustrates another example of the scanning path in the erasure process using the drawing and erasing apparatus illustrated in FIG. 1.

FIG. 7 is a schematic cross-sectional diagram illustrating an example of a configuration of a reversible recording medium according to a modification of the present disclosure.

FIG. 8A is a perspective diagram illustrating an example of an appearance of Application Example 1.

FIG. 8B is a perspective diagram illustrating another example of the appearance of Application Example 1.

FIG. 9A is a perspective diagram illustrating an example of an appearance (of a front side) of Application Example 2.

FIG. 9B is a perspective diagram illustrating an example of an appearance (of a rear side) of Application Example 2.

FIG. 10A is a perspective diagram illustrating an example of an appearance of Application Example 3.

FIG. 10B is a perspective diagram illustrating another example of the appearance of Application Example 3.

FIG. 11 is an explanatory diagram illustrating a configuration example of Application Example 4.

FIG. 12A is a perspective diagram illustrating an example of an appearance (of an upper surface) of Application Example 5.

FIG. 12B is a perspective diagram illustrating an example of an appearance (of a side surface) of Application Example 5.

FIG. 13 is a perspective diagram illustrating an example of an appearance of Application Example 6.

MODES FOR CARRYING OUT THE INVENTION

In the following, an embodiment of the present disclosure is described in detail with reference to the drawings. It is to be noted that the following description is directed to a specific example of the present disclosure, and the present disclosure is not limited to the following implementations. In addition, with regard to a layout, dimensions, dimension ratios, etc. of the components illustrated in each drawing, the present disclosure is not limited to those, either. Note that the description is given in the following order.

1. Embodiment (An example of a drawing and erasing apparatus including a controller that controls a main scanning speed and a sub-scanning speed of a scanner section to cause the scanner section to perform overlapping scanning of a predetermined region on a reversible recording medium during erasure)
   - 1-1. Configuration of Reversible Recording Medium
   - 1-2. Manufacturing Method of Reversible Recording Medium
   - 1-3. Configuration of Drawing and Erasing Apparatus
   - 1-4. Method of Writing and Erasing on/from Reversible Recording Medium
   - 1-5. Workings and Effects
2. Modification Example (An example of a reversible recording medium in which a recording layer contains a plurality of types of coloring compounds)
3. Application Examples 1 to 6
4. Examples

1. EMBODIMENT

A drawing and erasing apparatus according to an embodiment of the present disclosure (a drawing and erasing apparatus 1) will be described. FIG. 1 illustrates a system configuration example of the drawing and erasing apparatus 1 according to the present embodiment. The drawing and erasing apparatus 1 performs, on a reversible recording medium 100, writing of information (drawing) and erasure of the written information. First, the reversible recording medium 100 will be described, and then the drawing and erasing apparatus 1 will be described.

(1-1. Configuration of Reversible Recording Medium)

FIG. 2 illustrates a cross-sectional configuration of a reversible recording medium 100A, which is a specific example of the reversible recording medium 100 illustrated in FIG. 1. It is to be noted that the reversible recording medium 100A illustrated in FIG. 2 is a schematic representation of the cross-sectional configuration, and has dimensions and a shape that may be different from actual dimensions and shape. For example, the reversible recording medium 100A includes a recording layer 112 disposed on a support base 11, the recording layer 112 being reversibly changeable between a recording state and an erasing state. For example, the recording layer 112 has a configuration in which three layers (a recording layer 112M, a recording layer 112C, and a recording layer 112Y) that are different from each other in developed color hue are stacked in this order. Intermediate layers 113 and 114 each including a plurality of layers (here, three layers) are provided respectively between the recording layer 112M and the recording layer 112C, and between the recording layer 112C and the recording layer 112Y. A protective layer 15 is provided on the recording layer 112Y.

The support base 111 is to support the recording layer 112. The support base 111 includes a material having high heat resistance and high dimensional stability in a plane direction. The support base 111 may have either light transmissivity or non-light transmissivity. For example, the support base 111 may be a substrate having a rigidity, such as a wafer, or may include a thin-layer glass, film, paper, or the like having flexibility. Using a flexible substrate as the support base 111 makes it possible to achieve a flexible (bendable) reversible recording medium.

Examples of a composition material of the support base 111 include an inorganic material, a metal material, a polymeric material such as plastic, or the like. Specifically, examples of the inorganic material include silicon (Si), silicon oxide ($SiO_x$), silicon nitride ($SiN_x$), aluminum oxide ($AlO_x$), magnesium oxide ($MgO_x$), and the like. Silicon oxide includes glass, spin-on glass (SOG), or the like. Examples of the metal material include metal alone such as aluminum (Al), copper (Cu), silver (Ag), gold (Au), platinum (Pt), palladium (Pd), nickel (Ni), tin (Sn), cobalt (Co), rhodium (Rh), iridium (Ir), iron (Fe), ruthenium (Ru), osmium (Os), manganese (Mn), molybdenum (Mo), tungsten (W), niobium (Nb), tantalum (Ta), titanium (Ti), bismuth (Bi), antimony (Sb), or lead (Pb), or an alloy that contains two or more of these. Specific examples of the alloy include stainless steel (SUS), an aluminum alloy, a magnesium alloy, and a titanium alloy. The polymeric material includes phenolic resin, epoxy resin, melamine resin, urea resin, unsaturated polyester resin, alkyd resin, urethane resin, polyimide, polyethylene, high density polyethylene, medium density polyethylene, low density polyethylene, polypropylene, polyvinyl chloride, polyvinylidene chloride, polystyrene, polyvinyl acetate, polyurethane, acrylonitrile butadiene-styrene resin (ABS), acrylic resin (PMMA), polyamide, nylon, polyacetal, polycarbonate (PC), modified polyphenylene ether, polyethylene telephthalate (PET), polybutylene terephthalate, cyclic poly olefin, polyphenylene sulfide, polytetrafluoroethylene (PTFE), polysulphone, poly ethersulfone, amorphous polyarylate, liquid crystal polymer, poly etheretherketone (PEEK), polyamide imide, polyethylene naphthalate (PEN), triacetyl cellulose, cellulose, or a copolymer of these, glass fiber reinforced plastic, carbon-fiber reinforced plastic (CFRP), or the like. It is to be noted that a reflective layer may be provided on an upper surface or a lower surface of the support base 111. Providing the reflective layer makes it possible to achieve more vivid color display.

The recording layer 112 allows reversible writing and erasure of information by heat, and is configured using a material that allows stable repeated recording and allows control of a decoloring state and a color-developing state. The recording layer 112 includes, for example, the recording layer 112M exhibiting a magenta color (M), the recording layer 112C exhibiting a cyan color (C), and the recording layer 112Y exhibiting a yellow color (Y).

In the recording layer 112, the recording layers 112M, 112C, and 112Y include, for example, polymeric materials that contain coloring compounds (reversible thermal color-developing compositions) that are to exhibit colors different from each other, color developing/reducing agents corresponding to the respective coloring compounds, and photothermal conversion materials that absorb light rays of wavelength regions different from each other to generate heat. This allows the reversible recording medium 100A to perform coloring for multicolor display. Specifically, for example, the recording layer 112M contains a coloring compound that is to exhibit a magenta color, a color developing/reducing agent corresponding thereto, and a photothermal conversion material that absorbs, for example, infrared light having an emission wavelength λ1 to generate heat. For example, the recording layer 112C contains a coloring compound that is to develop a cyan color, a color developing/reducing agent corresponding thereto, and a photothermal conversion material that absorbs and develops, for example, infrared light having an emission wavelength λ2. For example, the recording layer 112Y contains a coloring compound that is to exhibit a yellow color, a color developing/reducing agent corresponding thereto, and a photothermal conversion material that absorbs, for example, infrared light having an emission wavelength λ3 to generate heat. The emission wavelengths λ1, λ2, and λ3 are different from each other.

It is to be noted that the recording layers 112M, 112C, and 112Y become transparent in the decoloring state. This allows the reversible recording medium 100A to perform recording in a wide color gamut. The recording layers 112M, 112C, and 112Y have a thickness in a stacking direction (hereinafter, simply referred to as a thickness) of 1 μm or more and not more than 10 μm, for example.

An example of the coloring compounds is a leuco dye. An example of the leuco dye is an existing dye for thermal paper. One specific example may be a compound represented by Formula (1) below that includes, in a molecule, a group having an electron-donating property, for example.

[Chem. 1]

(1)

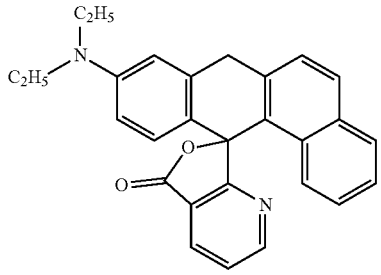

The coloring compounds used in the recording layers 112M, 112C, and 112Y are not particularly limitative, and are selectable as appropriate in accordance with a purpose. Examples of specific coloring compounds other than the compound represented by Formula (1) above include a fluoran-based compound, a triphenylmethanephthalide-based compound, an azaphthalide-based compound, a phenothiazine-based compound, a leuco auramine-based compound, an indorinophthalide-based compound, and the like. Other examples include 2-anilino-3-methyl-6-diethylaminofluoran, 2-anilino-3-methyl-6-di(n-butylamino) fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-methylamino) fluoran, 2-anilino-3-methyl-6-(N-n-amyl-N-ethylamino) fluoran, 2-anilino-3-methyl-6-(N-iso-amyl-N-ethylamino) fluoran, 2-anilino-3-methyl-6-(N-n-propyl-N-isopropylamino) fluoran, 2-anilino-3-methyl-6-(N-cyclohexyl-N-methylamino) fluoran, 2-anilino-3-methyl-6-(N-ethyl-p-toluidino) fluoran, 2-anilino-3-methyl-6-(N-methyl-p-toluidino) fluoran, 2-(m-trichloromethylanilino)-3-methyl-6-diethylaminofluoran, 2-(m-trifluoromethylanilino)-3-methyl-6-diethylaminofluoran, 2-(m-trichloromethylanilino)-3-methyl-6-(N-cyclohexyl-N-methylamino) fluoran, 2-(2,4-dimethylanilino)-3-methyl-6-diethylaminofluoran, 2-(N-ethyl-p-toluidino)-3-methyl-6-(N-ethylanilino) fluoran, 2-(N-ethyl-p-toluidino)-3-methyl-6-(N-propyl-p-toluidino) fluoran, 2-anilino-6-(N-n-hexyl-N-ethylamino) fluoran, 2-(o-chloroanilino)-6-diethylaminofluoran, 2-(o-chloroanilino)-6-dibutylaminofluoran, 2-(m-trifluoromethylanilino)-6-diethylaminofluoran, 2,3 -dimethyl-6-dimethylaminofluoran, 3-methyl-6-(N-ethyl-p-toluidino) fluoran, 2-chloro-6-diethylaminofluoran, 2-bromo-6-diethylaminofluoran, 2-chloro-6-dipropylaminofluoran, 3-chloro-6-cyclohexylaminofluoran, 3-bromo-6-cyclohexylaminofluoran, 2-chloro-6-(N-ethyl-N-isoamylamino) fluoran, 2-chloro-3-methyl-6-diethylaminofluoran, 2-anilino-3-chloro-6-diethylaminofluoran, 2-(o-chloroanilino)-3-chloro-6-cyclohexylaminofluoran, 2-(m-trifluoromethylanilino)-3-chloro-6-diethylaminofluoran, 2-(2,3-dichloroanilino)-3-chloro-6-diethylaminofluoran, 1,2-benzo-6-diethylaminofluoran, 3-diethylamino-6-(m-trifluoromethylanilino) fluoran, 3-(1-ethyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3-(1-octyl-2-methylindole-3-yl)-3-(2-ethoxy -4-diethylaminophenyl)-4-azaphthalide, 3-(1-ethyl-2-methylin dol e-3 -yl)-3-(2-methyl-4-diethylaminophenyl)-4-azaphthalide, 3-(1-ethyl-2-methylindole-3-yl)-3-(2-methyl-4-diethylaminophenyl)-7-azaphthalide, 3-(1-ethyl-2-methylindole-3-y1)-3-(4-diethylaminophenyl)-4-azaphthalide, 3-(1-ethyl-2-methylindole-3-yl)-3-(4-N-n-amyl-N-methylaminophenyl)-4-azaphthalide, 3-(1-methyl-2-methylindole-3-y1)-3-(2-hexyloxy-4-diethylaminophenyl)-4-azaphthalide, 3,3-bis(2-ethoxy-4-diethylaminophenyl)-4-azaphthalide, 3,3-bis(2-ethoxy-4-diethylaminophenyl)-7-azaphthalide, 2-(p-acetylanilino)-6-(N-n-amyl-N-n-butylamino) fluoran, 2-benzylamino-6-(N-ethyl-p-toluidino) fluoran, 2-benzylamino-6-(N-methyl-2,4-dimethylanilino) fluoran, 2-benzylamino-6-(N-ethyl-2,4-dimethylanilino) fluoran, 2-benzylamino-6-(N-methyl-p-toluidino) fluoran, 2-benzylamino-6-(N-ethyl-p-toluidino) fluoran, 2-(di-p-methylbenzylamino)-6-(N-ethyl-p-toluidino) fluoran, 2-(α-phenylethylamino)-6-(N-ethyl-p-toluidino) fluoran, 2-methylamino-6-(N-methylanilino) fluoran, 2-methylamino-6-(N-ethylanilino) fluoran, 2-methylamino-6-(N-propylanilino) fluoran, 2-ethylamino-6-(N-methyl-p-toluidino) fluoran, 2-methylamino-6-(N-methyl-2,4-dimethylanilino) fluoran, 2-ethylamino-6-(N-ethyl-2,4-dimethylanilino) fluoran, 2-dimethylamino-6-(N-methylanilino) fluoran, 2-dimethylamino-6-(N-ethylanilino) fluoran, 2-diethylamino-6-(N-methyl-p-toluidino) fluoran, 2-diethylamino-6-(N-ethyl-p-toluidino) fluoran, 2-dipropylamino-6-(N-methylanilino) fluoran, 2-dipropylamino-6-(N-ethylanilino) fluoran, 2-amino-6-(N-methylanilino) fluoran, 2-amino-6-(N-ethylanilino) fluoran, 2-amino-6-(N-propylanilino) fluoran, 2-amino-6-(N-methyl-p-toluidino) fluoran, 2-amino-6-(N-ethyl-p-toluidino) fluoran, 2-amino-6-(N-propyl-p-toluidino) fluoran, 2-amino-6-(N-methyl-p-ethylanilino) fluoran, 2-amino-6-(N-ethyl-p-ethylanilino) fluoran, 2-amino-6-(N-propyl-p-ethylanilino) fluoran, 2-amino-6-(N-methyl-2,4-dimethylanilino) fluoran, 2-amino-6-(N-ethyl-2,4-dimethylanilino) fluoran, 2-amino-6-(N-propyl-2,4-dimethylanilino) fluoran, 2-amino-6-(N-methyl-p-chloroanilino) fluoran, 2-amino-6-(N-ethyl-p-chloroanilino) fluoran, 2-amino-6-(N-propyl-p-chloroanilino) fluoran, 1,2-benzo-6-(N-ethyl-N-isoamylamino) fluoran, 1,2-benzo-6-dibutylaminofluoran, 1,2-benzo-6-(N-methyl-N-cyclohexylamino) fluoran, 1,2-benzo-6-(N-ethyl-N-toluidino) fluoran, and the like. For each of the recording layers 112M, 112C, and 112Y, one of the above-described coloring compounds may be used alone, or two or more of them may be used in combination.

The color developing/reducing agent is to develop a color of an achromatic coloring compound or decolor a coloring compound exhibiting a predetermined color, for example. Examples of the color developing/reducing agent include a phenol derivative, a salicylic acid derivative, a urea derivative, and the like. A specific example may be a compound represented by Formula (2) below that has a salicylic acid skeleton and includes, in a molecule, a group having an electron-accepting property.

[Chem. 2]

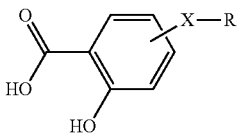

(2)

(X represents any one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO—, and —CONHNHCONH—. R represents a straight-chain hydrocarbon group having a carbon number of 25 or more and not more than 34.)

Other examples of the color developing/reducing agent include 4,4'-isopropylidenebisphenol, 4,4'-isopropylidenebis(o-methylphenol), 4,4'-secondary butylidene bisphenol, 4,4'-isopropylidenebis(2-tertiary butylphenol), p-nitrobenzoic acid zinc, 1,3,5-tris(4-tert-butyl-3-hydroxy-2,6-dimethylbenzyl) isocyanuric acid, 2,2-(3,4'-dihydroxydiphenyl) propane, bis(4-hydroxy-3-methylphenyl) sulfide, 4-{β-(p-methoxyphenoxy)ethoxy}salicylic acid, 1,7-bis(4-hydroxyphenylthio)-3,5-dioxaheptane, 1,5-bis(4-hydroxyphenylthio)-5-oxapentane, monobenzyl phthalate ester monocalcium salt, 4,4'-cyclohexylidenediphenol, 4,4'-isopropylidenebis(2-chlorophenol), 2,2'-methylenebis(4-methyl-6-tert-butylphenol), 4,4'-butylidenebis(6-tert-butyl-2-methyl) phenol, 1,1,3-tris(2-methyl-4-hydroxy-5-tert-butylphenyl) butane, 1,1,3-tris(2-methyl-4-hydroxy-5-cyclohexyl phenyl) butane, 4,4'-thiobis(6-tert-butyl-2-methyl) phenol, 4,4'-diphenol sulfone, 4-isopropoxy-4'-hydroxydiphenylsulfone (4-hydroxy-4'-isopropoxydiphenylsulfone), 4-benzyloxy4'-hydroxydiphenyl sulfone, 4,4'-diphenol sulfoxide, isopropyl p-hydroxybenzoate, benzyl p-hydroxybenzoate, benzyl protocatechuate, stearyl gallate, lauryl gallate, octyl gallate, 1,3-bis(4-hydroxyphenylthio)-propane, N,N'-diphenylthiourea, N,N'-di(m-chlorophenyl)thiourea, salicylanilide, bis(4-hydroxyphenyl) acetic acid methyl ester, bis(4-hydroxyphenyl) acetic acid benzyl ester, 1,3-bis(4-hydroxycumyl) benzene, 1,4-bis(4-hydroxycumyl) benzene, 2,4'-diphenol sulfone, 2,2'-diallyl-4,4'-diphenol sulfone, 3,4-dihydroxyphenyl-4'-methyldiphenyl sulfone, zinc 1-acetyloxy-2-naphthoate, zinc 2-acetyloxy-1-naphthoate, zinc 2-acetyloxy-3-naphthoate, α,α-bis(4-hydroxyphenyl)-α-methyltoluene, antipyrine complex of zinc thiocyanate, tetrabromobisphenol A, tetrabromobisphenol S, 4,4'-thiobis(2-methylphenol), 4,4'-thiobis(2-chlorophenol), dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, octacosylphosphonic acid, α-hydroxydodecylphosphonic acid, α-hydroxytetradecylphosphonic acid, α-hydroxyhexadecylphosphonic acid, α-hydroxyoctadecylphosphonic acid, α-hydroxy eicosylphosphonic acid, α-hydroxydocosylphosphonic acid, α-hydroxytetracosylphosphonic acid, dihexadecyl phosphate, dioctadecyl phosphate, dieicosyl phosphate, didocosyl phosphate, monohexadecyl phosphate, monooctadecyl phosphate, monoeicosyl phosphate, monodocosyl phosphate, methyl hexadecyl phosphate, methyl octadecyl phosphate, methyl eicosyl phosphate, methyl docosyl phosphate, amyl hexadecyl phosphate, octyl hexadecyl phosphate, lauryl hexadecyl phosphate, and the like. For each of the recording layers 112M, 112C, and 112Y, one of the above-described color developing/reducing agents may be used alone or two or more of them may be used in combination.

The photothermal conversion material absorbs, for example, light in a wavelength region having a property of the near infrared region (e.g., a wavelength of 700 nm or more and not more than 2500 nm) to generate heat. In the present embodiment, for the photothermal conversion materials to be used for the recording layers 112M, 112C, and 112Y, it is preferable to select a combination of materials having narrow light absorption bands that do not overlap each other. This makes it possible to selectively color or decolor a desired layer of the recording layers 112M, 112C, and 112Y. An example of the photothermal conversion material included in the recording layer 112M is one having an absorption peak at 915 nm. An example of the photothermal conversion material included in the recording layer 112C is one having an absorption peak at 860 nm. An example of the photothermal conversion material included in the recording layer 112Y is one having an absorption peak at 760 nm. Note that the foregoing absorption peaks are mere examples and non-limiting.

Examples of the photothermal conversion materials include organic compounds such as a compound having a phthalocyanine skeleton (a phthalocyanine-based dye), a compound having a naphthalocyanine skeleton (a naphthalocyanine-based dye), a compound having a squarylium skeleton (a squarylium-based dye), a diimonium salt, or an aminium salt; inorganic compounds such as a metal complex, e.g., a dithio complex or the like, tetratrioxide cobalt, iron oxide, chromium oxide, copper oxide, titanium black, ITO, or niobium nitride; organic meal-based compounds such as tantalum carbide; and the like.

Aside from the foregoing, a compound having a cyanine skeleton (a cyanine-based dye) with excellent light resistance and excellent heat resistance may be used. As used herein, the excellent light resistance refers to not undergoing decomposition during laser irradiation. The excellent heat resistance means that, for example, a maximum absorption peak value does not undergo a change by 20% or more in a case where, for example, the composition is formed into a film together with a polymeric material and the film is stored at 1150° C. for 30 minutes, for example. Examples of such a compound having a cyanine skeleton include a compound containing, in a molecule, at least one of a counter ion of any one of $SbF_6$, $PF_6$, $BF_4$, $ClO_4$, $CF_3SO_3$ and $(CF_3SO_3)_2N$ or a methine chain containing a five-membered ring or a six-membered ring.

It is to be noted that, although the cyanine-based dye is preferably provided with both of any one of the foregoing counter ions and the ring structure such as a five-membered ring and a six-membered ring in a methine chain, the provision of at least one of those allows sufficient light resistance and heat resistance to be secured. It is to be noted that a material with excellent light resistance and excellent heat resistance does not undergo decomposition during laser irradiation, as described above. Examples of a way to confirm the excellent light resistance include a method of measuring a peak change in an absorption spectrum during a xenon lamp irradiation test. If a change rate during irradiation for 30 minutes is 20% or less, it is possible to judge that the light resistance is favorable. Examples of a way to confirm the excellent heat resistance include a method of measuring a peak change in an absorption spectrum during storing at 1150° C. If a change rate after the 30-minute test is 20% or less, it is possible to judge that the heat resistance is favorable.

The polymeric material is preferably one that allows the coloring compound, the color developing/reducing agent, and the photothermal conversion material to be easily dispersed evenly therein. As the polymeric material, for example, a matrix resin is preferably used; examples thereof include a thermosetting resin and a thermoplastic resin. Specific examples thereof include polyvinyl chloride, polyvinyl acetate, vinyl chloride-vinyl acetate copolymer, ethyl cellulose, polystyrene, a styrene-based copolymer, a phenoxy resin, polyester, aromatic polyester, polyurethane, polycarbonate, polyacrylic ester, polymethacrylic ester, an acrylic acid-based copolymer, a maleic acid-based polymer, a cycloolefin copolymer, polyvinyl alcohol, modified polyvinyl alcohol, polyvinyl butyral, polyvinyl phenol, polyvinyl pyrrolidone, hydroxyethyl cellulose, carboxymethyl cellulose, starch, a phenolic resin, an epoxy resin, a melamine resin, an urea resin, an unsaturated polyester resin, an alkyd resin, an urethane resin, a polyarylate resin, a polyimide, a polyamide, a polyamideimide, and the like. The polymeric materials described above may be crosslinked for use.

The recording layers 112M, 112C, and 112Y each include at least one of the coloring compounds, at least one of the color developing/reducing agents, and at least one of the photothermal conversion materials. The recording layers 112M, 112C, and 112Y may include, aside from the foregoing materials, various additives such as a sensitizer or an ultraviolet absorbing agent, for example.

The intermediate layers 113 and 114 are provided to suppress the occurrence of dispersion of contained molecules or heat transfer during drawing between the recording layer 112M and the recording layer 112C and between the recording layer 112C and the recording layer 112Y. The intermediate layer 113 has, for example, a three-layer structure and has a configuration in which a first layer 113A, a second layer 113B, and a third layer 113C are stacked in this order. The intermediate layer 114 has, for example, a three-layer structure like the intermediate layer 113, and has a configuration in which a first layer 114A, a second layer 114B, and a third layer 114C are stacked in this order. Each of the layers 113A, 113B, 113C (, 114A, 114B, and 114C) is configured using a typical polymeric material having translucency, and the middle layers (the second layers 113B and 114B) in the foregoing stacked structures, in particular, preferably include materials having a Young's modulus lower than that of the other layers (the first layers 113A and 114A and the third layers 113C and 114C).

The first layers 113A and 114A and the third layers 113C and 114C are configured, for example, using typical polymeric materials having translucency. Specific examples of the materials include polyvinyl chloride, polyvinyl acetate, vinyl chloride-vinyl acetate copolymers, ethyl cellulose, polystyrene, styrene-based copolymers, phenoxy resins, polyester, aromatic polyester, polyurethane, polycarbonate, polyacrylic esters, polymethacrylic esters, acrylic acid-based copolymers, maleic acid-based polymers, cycloolefin copolymers, polyvinyl alcohol, modified polyvinyl alcohol, polyvinyl butyral, polyvinyl phenol, polyvinyl pyrrolidone, hydroxyethyl cellulose, carboxymethyl cellulose, starch, phenolic resins, epoxy resins, melamine resins, urea resins, unsaturated polyester resins, alkyd resins, urethane resins, polyarylate resins, polyimides, polyamides, polyamideimides, and the like.

Examples of the materials of the second layers 113B and 114B include silicone-based elastomers, acrylic elastomers, urethane-based elastomers, styrene-based elastomers, polyester-based elastomers, olefin-based elastomers, polyvinyl chloride-based elastomers, natural rubber, styrene-butadiene rubber, isoprene rubber, butadiene rubber, chloroprene rubber, acrylonitrile-butadiene rubber, butyl rubber, ethylene-propylene rubber, ethylene-propylene-diene rubber, urethane rubber, silicone rubber, fluororubber, chlorosulfonated polyethylene, chlorinated polyethylene, acrylic rubber, polysulfide rubber, epichlorohydrin rubber, polydimethylsiloxane (PDMS), polyvinyl chloride, polyvinyl acetate, vinyl chloride-vinyl acetate copolymers, ethyl cellulose, polystyrene, styrene-based copolymers, phenoxy resins, polyester, aromatic polyester, polyurethane, polycarbonate, polyacrylic acid esters, polymethacrylic acid esters, acrylic acid-based copolymers, maleic acid-based polymers, cycloolefin copolymers, polyvinyl alcohol, modified polyvinyl alcohol, polyvinyl butyral, polyvinyl phenol, polyvinyl pyrrolidone, hydroxyethyl cellulose, carboxymethyl cellulose, starch, phenolic resins, epoxy resins, melamine resins, urea resins, unsaturated polyester resins, alkyd resins, urethane resins, polyarylate resins, polyimides, polyamides, polyamideimides, and the like.

Combinations of the materials used to configure the layers 113A, 113B, 113C (, 114A, 114B, and 114C) are not limited as long as the second layers 113B and 114B include materials lower in Young's modulus than those included in the first layers 113A and 114A and the third layers 113C and 114C. In addition, for the intermediate layers 113 and 114, the foregoing polymeric materials may be crosslinked for use. Further, the intermediate layers 113 and 24 may include various additives such as an ultraviolet absorbing agent, for example.

The intermediate layers 113 and 114 each preferably have a thickness of, for example, 1 μm or more and not more than 100 μm, and more preferably, for example, 5 μm or more and not more than 20 μm. Among these, the first layers 113A and 114A each preferably have a thickness of, for example, 0.1 μm or more and not more than 10 μm, and the second layers 113B and 114B each preferably have a thickness of, for example, 0.01 m or more and not more than 10 μm. The third layers 113C and 114C each preferably have a thickness of, for example, 0.1 μm or more and not more than 10 μm.

The protective layer 115 is provided to protect a surface of the recording layer 112 (here, the recording layer 112Y), and is configured using an ultraviolet curable resin or a thermosetting resin, for example. The protective layer 115 has a thickness of, for example, 0.1 p.m or more and not more than 100 p.m.

(1-2. Manufacturing Method of Reversible Recording Medium)

It is possible to manufacture the reversible recording medium 100A of the present embodiment by using, for example, a coating method. It is to be noted that the manufacturing method described below is an example of a method in which the layers constituting the reversible recording medium 100A are formed directly on the support base 111.

First, as the support base 111, a white polyethylene telephthalate substrate having a thickness of 0.188 mm is prepared. Next, to 8.8 g of a solvent (methyl ethyl ketone (MEK)), 0.23 g of a leuco dye (a magenta color) represented by Formula (1) above, 0.4 g of a color developing/reducing agent (alkyl salicylate) represented by Formula (2) above, 0.01 g of a phthalocyanine-based photothermal conversion material A (absorption wavelength: 915 nm), and 0.8 g of a polymeric material (poly(vinyl chloride-co-vinyl acetate (9:1))) are added and dispersed using a rocking mill for 2 hours to prepare a uniform dispersion liquid (coating material A). The coating material A is applied onto the support base 111 using a wire bar, and then a heating and drying process is performed at 70° C. for 5 minutes to form the recording layer 112M that has a thickness of 3 μm and exhibits the magenta color.

Subsequently, a polyester aqueous solution is applied onto the recording layer M and then dried to form the first layer 113A having a thickness of 3 μm. Next, a polyester aqueous solution having a low Young's modulus is applied onto the first layer 113A and then dried to form the second layer 113B having a thickness of 6 p.m. Subsequently, a polyester aqueous solution is applied onto the second layer 113B, and then dried to form the third layer 113C having a thickness of 3 μm.

Next, to 8.8 g of a solvent (methyl ethyl ketone (MEK)), 0.2 g of a leuco dye (a cyan color) represented by Formula (3) below, 0.4 g of the color developing/reducing agent (alkyl salicylate) represented by Formula (2) above, 0.01 g of a phthalocyanine-based photothermal conversion material B (absorption wavelength: 860 nm), and 0.8 g of a polymeric material (poly(vinyl chloride-co-vinyl acetate (9:1))) are added and dispersed for 2 hours using a rocking mill to prepare a uniform dispersion liquid (coating material B). The coating material B is applied onto the intermediate layer, and a heating and drying process is performed at 70° C. for 5 minutes to form the recording layer 112C that has a thickness of 3 μm and exhibits the cyan color.

[Chem. 3]

(3)

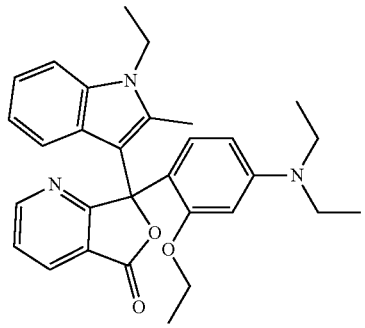

Subsequently, a polyester aqueous solution is applied onto the recording layer C and then dried to form the first layer 114A having a thickness of 3 μm. Next, a polyester aqueous solution having a low Young's modulus is applied onto the first layer 114A and then dried to form the second layer 114B having a thickness of 6 μm. Subsequently, a polyester aqueous solution is applied onto the second layer 114B and then dried to form the third layer 114C having a thickness of 3 μm.

Next, to 8.8 g of a solvent (methyl ethyl ketone (MEK)), 0.115 g of a leuco dye (a yellow color) represented by Formula (4) below, 0.4 g of the color developing/reducing agent (alkyl salicylate) represented by Formula (2) above, 0.01 g of a phthalocyanine-based photothermal conversion material C (absorption wavelength: 760 nm), and 0.8 g of a polymer (poly(vinyl chloride-co-vinyl acetate (9:1))) are added and dispersed for 2 hours using a rocking mill to prepare a uniform dispersion liquid (coating material C). The coating material C is applied onto the intermediate layer, and a heating and drying process is performed at 70° C. for 5 minutes to form the recording layer 112Y that has a thickness of 3 μm and exhibits the yellow color.

[Chem. 4]

(4)

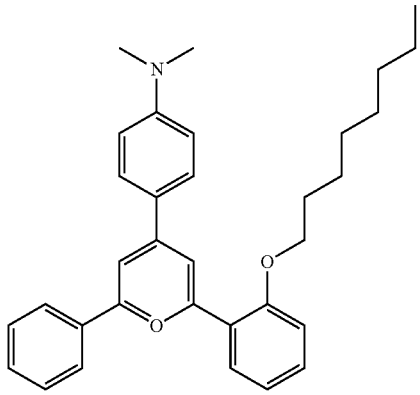

Finally, on the recording layer 112Y, the protective layer 115 having a thickness of about 2 μm is formed using an ultraviolet curable resin. The reversible recording medium 100A illustrated in FIG. 1 is completed thus.

Further, it is also possible to use the following method to manufacture the reversible recording medium 100A. The manufacturing method of the reversible recording medium 100A described below is an example of a manufacturing method using a transfer method.

First, a polyethylene terephthalate substrate for mold release and transfer having a thickness of 50 μm is prepared as a temporary base for transfer. Subsequently, a protective layer having a thickness of about 2 μm is formed using an ultraviolet curable resin on one surface (a release coating surface) of the polyethylene terephthalate substrate for mold release and transfer.

Subsequently, to 8.8 g of a solvent (methyl ethyl ketone (MEK)), 0.115 g of the leuco dye (the yellow color) represented by Formula (4) above, 0.4 g of the color developing/reducing agent (alkyl salicylate) represented by Formula (2) above, 0.01 g of the phthalocyanine-based photothermal conversion material C (absorption wavelength: 760 nm), and 0.8 g of a polymer (poly(vinyl chloride-co-vinyl acetate (9:1))) are added and dispersed for 2 hours using a rocking mill to prepare a uniform dispersion liquid (coating material C). The coating material C is applied onto the intermediate layer, and a heating and drying process is performed at 70° C. for 5 minutes to form the recording layer 112Y that has a thickness of 3 μm and exhibits the yellow color.

Next, a polyester aqueous solution is applied onto the recording layer 112Y and then dried to form the third layer 114C having a thickness of 3 μm. Subsequently, a polyester aqueous solution having a low Young's modulus is applied onto the third layer 114C and then dried to form the second layer 114B having a thickness of 6 μm. Next, a polyester aqueous solution is applied onto the second layer 114B and then dried to form the first layer 114A having a thickness of 3 μm.

Subsequently, to 8.8 g of a solvent (methyl ethyl ketone (MEK)), 0.2 g of the leuco dye (the cyan color) represented by Formula (3) above, 0.4 g of the color developing/reducing agent (alkyl salicylate) represented by Formula (2) above, 0.01 g of the phthalocyanine-based photothermal conversion material B (absorption wavelength: 860 nm), and 0.8 g of a polymeric material (poly(vinyl chloride-co-vinyl acetate (9:1))) are added and dispersed for 2 hours using a rocking mill to prepare a uniform dispersion liquid (coating material B). The coating material B is applied onto the intermediate layer, and a heating and drying process is performed at 70° C. for 5 minutes to form the recording layer 112C that has a thickness of 3 μm and exhibits the cyan color.

Next, a polyester aqueous solution is applied onto the recording layer 112C and then dried to form the third layer 113C having a thickness of 3 μm. Subsequently, a polyester aqueous solution having a low Young's modulus is applied onto the third layer 113C and then dried to form the second layer 113B having a thickness of 6 μm. Subsequently, a polyester aqueous solution is applied onto the second layer 113B, and then dried to form the first layer 113A having a thickness of 3 μm.

Subsequently, to 8.8 g of a solvent (methyl ethyl ketone (MEK)), 0.23 g of the leuco dye (the magenta color) represented by Formula (1) above, 0.4 g of the color developing/reducing agent (alkyl salicylate) represented by Formula (2) above, 0.01 g of the phthalocyanine-based photothermal conversion material A (absorption wavelength: 915 nm), and 0.8 g of a polymeric material (poly (vinyl chloride-co-vinyl acetate (9:1))) are added and dispersed using a rocking mill for 2 hours to prepare a uniform dispersion liquid (coating material A). The coating material A is applied onto the intermediate layer, and a heating and drying process is performed at 70° C. for 5 minutes to form the recording layer 112M that has a thickness of 3 μm and exhibits the magenta color.

Subsequently, an optical adhesive sheet (OCA) is bonded to the intermediate layer 113. Finally, the foregoing stack provided on the temporary base for transfer is transferred to a housing serving as the support base 111, thereby completing the reversible recording medium 100A illustrated in FIG. 1.

It is to be noted that the recording layers 112M, 112C, and 112Y may each be formed using a method other than coating described above. For example, another base coated with a film in advance may be bonded to the support base 111 via, e.g., an adhesive film, to form each of the recording layers 112M, 112C, and 112Y. Alternatively, the support base 111 may be soaked in a coating material to form each of the recording layers 112M, 112C, and 112Y.

(1-3. Configuration of Drawing and Erasing Apparatus)

Next, the drawing and erasing apparatus 1 according to the present embodiment will be described.

The drawing and erasing apparatus 1 includes, for example, a signal processing circuit 10 (a controller), a laser drive circuit 20, a light source section 30, a multiplexer 40, a scanner section 50, a scanner drive circuit 60, a switching section 70, a reception section 90, and a storage section 80.

The signal processing circuit 10 is, for example, together with the laser drive circuit 20, provided to control a peak value or the like of a current pulse to be applied to the light source section 30 (e.g., each of light sources 31A, 31B, and 31C to be described later) in accordance with characteristics of the reversible recording medium 100 and conditions under which writing on the reversible recording medium 100 is performed. For example, the signal processing circuit 10 generates, from a signal Din (a drawing signal or an erasure signal) inputted externally, an image signal (an image signal for drawing or an image signal for erasure) synchronizing with a scanner operation of the scanner section 50 and corresponding to characteristics of a laser light beam such as its wavelength.

For example, the signal processing circuit 10 performs conversion (color gamut conversion) of the inputted signal Din (drawing signal or erasure signal) into an image signal corresponding to a wavelength of each of the light sources in the light source section 30. For example, the signal processing circuit 10 generates a projection-image clock signal synchronizing with a scanner operation of the scanner section 50. For example, the signal processing circuit 10 generates a projection image signal (a projection image signal for drawing or a projection image signal for erasure) to cause a laser light beam to be emitted in accordance with the generated image signal. For example, the signal processing circuit 10 outputs the generated projection image signal to the laser drive circuit 20. In addition, for example, the signal processing circuit 10 outputs the projection-image clock signal to the laser drive circuit 20 where necessary. Here, as described later, "where necessary" is a case of using the projection-image clock signal when synchronizing a signal source of a high-frequency signal with the image signal, etc.

For example, the laser drive circuit 20 drives the light sources 31A, 31B, and 31C of the light source section 30 in accordance with the projection image signals corresponding to respective wavelengths. For example, the laser drive circuit 20 controls luminance (brightness and darkness) of the laser light beam in order to draw an image (an image for drawing or an image for erasure) corresponding to the projection image signal. For example, the laser drive circuit 20 includes a drive circuit 21A that drives the light source 31A, a drive circuit 21B that drives the light source 31B, and a drive circuit 21C that drives the light source 31C. The light sources 31A, 31B, and 31C each output a laser light beam of a near infrared range (700 nm to 2500 nm). For example, the light source 31A is a semiconductor laser that outputs a laser light beam La having the emission wavelength λ1. For example, the light source 31B is a semiconductor laser that outputs a laser light beam Lb having the emission wavelength λ2. For example, the light source 31C is a semiconductor laser that outputs a laser light beam Lc having the emission wavelength λ3. For example, the emission wavelengths λ1 and λ2 satisfy Condition 1 (Expression (1) and Expression (2)) below. The emission wavelengths λ2 and λ3 may satisfy Condition 2 (Expression (3) and Expression (4)) below.

Condition 1:

$$\lambda a2<\lambda 1<\lambda a1 \quad (1)$$

$$\lambda a3\leq\lambda 2<\lambda a2 \quad (2)$$

Condition 2:

$$\lambda a1=10\text{ nm}<\lambda 1<a1+10\text{ nm} \quad (3)$$

$$\lambda a3<\lambda 2<\lambda a2 \quad (4)$$

Here, for example, λa1 is an absorption wavelength (absorption peak wavelength) of the recording layer 112M, and is 915 nm, for example. λa2 is an absorption wavelength (absorption peak wavelength) of the recording layer 112C to be described later, and is 860 nm, for example. λa3 is an absorption wavelength (absorption peak wavelength) of the recording layer 112Y to be described later, and is 760 nm, for example. It is to be noted that "±10 nm" in Expression (3) represents an allowable error range. In a case where the emission wavelengths λ1 and λ2 satisfy Condition 1 described above, the emission wavelength λ1 is 880 nm, for example, and the emission wavelength λ2 is 790 nm, for example. In a case where the emission wavelengths λ1 and λ2 satisfy Condition 2 described above, the emission wavelength λ1 is 920 nm, for example, and the emission wavelength λ2 is 790 nm, for example.

The light source section 30 includes a light source used in writing information on and erasing written information from the reversible recording medium 100. For example, the light source section 30 includes the three light sources 31A, 31B, and 31C.

For example, the multiplexer 40 includes two reflective mirrors 41a and 41*d* and two dichroic mirrors 41*b* and 41*c*. For example, the laser light beams La, Lb, and Lc outputted from the light sources 31A, 31B, and 31C are each turned into substantially parallel light (collimated light) by a collimate lens. Subsequently, for example, the laser light beam La is reflected by the reflective mirror 41*a* and is also reflected by the dichroic mirror 41*b*. The laser light beam Lb is transmitted through the dichroic mirrors 41*b* and 41*c*. The laser light beam Lc is reflected by the reflective mirror 41*d* and is also reflected by the dichroic mirror 41*c*. The laser light beam La, the laser light beam Lb, and the laser light beam Lc are thereby multiplexed. The light source section 30 further includes a lens 42 that adjusts a beam shape of multiplexed light Lm obtained through multiplexing when erasure is performed. For example, the multiplexer 40 outputs the multiplexed light Lm obtained through multiplexing to the scanner section 50.

For example, the scanner section 50 performs line-sequential scanning on a surface of the reversible recording medium 100 with the multiplexed light Lm entering from the multiplexer 40. The scanner section 50 includes, for example, a dual axis scanner 51 and an fθ lens 52. For example, the dual axis scanner 51 is a galvanometer mirror. The fθ lens 52 converts a uniform rotational motion by the dual axis scanner 51 into a uniform linear motion of a spot moving on a focal plane (the surface of the reversible recording medium 100).

For example, the scanner drive circuit 60 drives the scanner section 50 in synchronization with the projection-image clock signal inputted from the signal processing circuit 10. In addition, for example, in a case where a signal concerning an irradiation angle of the dual axis scanner 51 or the like is inputted from the scanner section 50, the scanner drive circuit 60 drives the scanner section 50 on the basis of the signal to obtain a desired irradiation angle.

The switching section 70 is provided to switch the optical system of the multiplexer 40 when drawing on the reversible recording medium 100 is performed and when erasure therefrom is performed. Specifically, the switching section 70 is, for example, manually operated by the user to mount the lens 42 to the optical system of the multiplexer 40 when erasure is performed and to dismount the lens 42 from the optical system of the multiplexer 40 when drawing is performed. Note that the switching section 70 may be configured to mount/dismount the lens 42 by scanning by a machine.

As illustrated in FIGS. 1 and 3, for example, the storage section 80 stores an identifier (a first identifier) for identifying the type of the reversible recording medium 100 and an identifier (a second identifier) for identifying one or a plurality of light sources included in the light source section 30 in association with each other. As illustrated in FIGS. 1 and 3, for example, the storage section 80 includes a database 81 in which the first identifier and the second identifier are associated with each other. The database 81 stores a product ID 81A for identifying the type of the reversible recording medium 100 as the first identifier, and stores a laser ID 81B for identifying the type of the light source corresponding to the reversible recording medium 100 as the second identifier.

In a case where the light source section 30 includes a light source that conforms to one of Condition 1 and Condition 2 (Expressions (1) to (4)), for example, "001" is assigned as the product ID 81A corresponding to Condition 1, and "880 (i.e., the light source 31A)" and "790 (i.e., the light source 31B)" are assigned as the laser ID 81B corresponding to Condition 1 in the database 81. Further, in the database 81, for example, "002" is assigned as the product ID 81A corresponding to Condition 2, and "915 (i.e., the light source 31C)" and "790 (i.e., the light source 31B)" are assigned as the laser ID 81B corresponding to Condition 2.

The reception section 90 receives, for example, an input of the product ID 81A as an identifier for identifying the type of the reversible recording medium 100. Further, the reception section 90 reads out the laser ID 81B corresponding to the product ID 81A from the database 81 as an identifier for identifying a light source for erasure for the reversible recording medium 100 corresponding to the product ID 81A. The reception section 90 further outputs the laser ID 81B read out from the database 81 to the signal processing circuit 10. The signal processing circuit 10 selects a plurality of light sources corresponding to the laser ID 81B inputted from the reception section 90, and controls the selected plurality of light sources through the laser drive circuit 22. At this time, the signal processing circuit 10 controls the light source section 30 to cause, for example, the reversible recording medium 100 to be irradiated with laser light having a smaller number of emission wavelengths (e.g., two) than the number (e.g., three) of the recording layers 112 included in the reversible recording medium 100 corresponding to the product ID 81A.

(1-4. Method of Writing and Erasing on/from Reversible Recording Medium)

Next, writing (drawing) and erasing of information on and from the reversible recording medium 100 will be described.

(Writing)

First, the reversible recording medium 100 is prepared and set in the drawing and erasing apparatus 1. Next, on the basis of the image signal for drawing, the reversible recording medium set in the drawing and erasing apparatus 1 is irradiated with the multiplexed light Lm obtained by appropriately multiplexing the laser light beam La having an emission wavelength of 915 nm, the laser light beam Lb having an emission wavelength of 860 nm, and the laser light beam Lc having an emission wavelength of 760 nm, for example.

As a result, the laser light beam La having the emission wavelength of 915 nm is absorbed by the photothermal conversion material in the recording layer 112M, and the heat generated by the photothermal conversion material causes the leuco dye in the recording layer 112M to reach a writing temperature and combine with the color developing agent to exhibit the magenta color. The color optical density of the magenta color depends on the intensity of the laser light beam having the emission wavelength of 915 nm. In addition, the laser light beam having the emission wavelength of 860 nm is absorbed by the photothermal conversion material in the recording layer 112C, and thereby the heat generated from the photothermal conversion material causes the leuco dye in the recording layer 112C to reach the writing temperature and combine with the color developing agent to exhibit the cyan color. The color optical density of the cyan color depends on the intensity of the laser light beam having the emission wavelength of 860 nm. In addition, the laser light beam having the emission wavelength of 760 nm is absorbed by the photothermal conversion material in the recording layer 112Y, and thereby the heat generated from the photothermal conversion material causes the leuco dye in the recording layer 112Y to reach the writing temperature and combine with the color developing agent to exhibit the yellow color. The color optical density of the yellow color depends on the intensity of the laser light beam having the emission wavelength of 760 nm. As a result, a mixture of the magenta color, the cyan color, and the yellow color develops into a desired color. In this manner, information is written on the reversible recording medium 100.

(Erasing)

First, the reversible recording medium 100 on which information is written as described above is prepared, and set in the drawing and erasing apparatus 1. Then, the user inputs the product ID to the reception section 90. The reception section 90 receives the product ID from the user and reads out the laser ID 81B related to the received product ID from the storage section 80 (database 81). The reception section 90 outputs the laser ID 81B read out from the storage section 80 (database 81) to the signal processing circuit 10. On the basis of the laser ID 81B inputted from the reception section 90, the signal processing circuit 10 selects a light source to be driven.

Subsequently, the signal processing circuit 10 generates a projection image signal (a projection image signal for erasure) for driving the selected light source. The signal processing circuit 10 outputs the generated projection image signal to the laser drive circuit 20. At this time, the signal processing circuit 10 controls the light source section 31 to irradiate the reversible recording medium 100 with laser light having a smaller number (e.g., two) of emission wavelengths than the number (e.g., three) of the recording layers 112 included in the set reversible recording medium 100.

Suppose here that the product ID inputted from the user is "001". At this time, the laser light beam La having the emission wavelength λ1 (e.g., 880 nm) is absorbed by, for example, the photothermal conversion material in each of the recording layers 112M and 112C. Further, the laser light beam Lb having the emission wavelength λ2 (e.g., 790 nm) is absorbed by, for example, the photothermal conversion material in the recording layer 112Y. Consequently, the heat generated from the respective photothermal conversion materials in the recording layers 112M, 112C, and 112Y causes the respective leuco dyes in the recording layers 112 to reach erasing temperatures and separate from the respective color developing agents, thus resulting in decoloration. In this manner, the drawing and erasing apparatus 1 erases information written on the reversible recording medium 100.

Meanwhile, suppose that the product ID inputted from the user is "002". At this time, the laser light beam La having the emission wavelength λ1 (e.g., 920 nm) is absorbed by, for example, the photothermal conversion material in each of the recording layers 112M and 112C. Further, the laser light beam Lb having the emission wavelength λ2 (e.g., 790 nm) is absorbed by, for example, the photothermal conversion material in the recording layer 112Y. Consequently, the heat generated from the respective photothermal conversion materials 10C in the recording layers 112M, 112C, and 112Y causes the respective leuco dyes in the recording layers 112 to reach the erasing temperatures and separate from the respective color developing agents, thus resulting in decoloration. In this manner, the drawing and erasing apparatus 1 erases information written on the reversible recording medium 100.

As described above, with the drawing and erasing apparatus 1 of the present embodiment, two types of erasing methods are selectable for the reversible recording medium 100.

Further, in the present embodiment, the multiplexed light Lm obtained through multiplexing on the basis of the image signal for erasure is used to irradiate the reversible recording medium 100 to provide a temperature profile as illustrated in FIG. 4, for example.

In the present embodiment, scanning is performed to cause the multiplexed light Lm to irradiate in an overlapping manner any region of the reversible recording medium 100 on which information is written. For example, the drawing and erasing apparatus 1 of the present embodiment has, as a scanning path of the multiplexed light Lm, for example, a pair of an irradiation start point and an irradiation end point crossing the reversible recording medium 100 in an X-axis direction. In the scanning path of the multiplexed light Lm, multiple pairs of the irradiation start point and the irradiation end point, including a first start point Si and a first end point E1, a second start point S2 and a second end point E2, a third start point S3 and a third end point E3, . . . , and an n-th start point Sn and an n-th end point En, are set. Further, the pairs of the irradiation start point and the irradiation end point are set to sequentially shift in a Y-axis direction, for example. Here, the X-axis direction is a main scanning direction, and the Y-axis direction is a sub-scanning direction.

FIGS. 5A to 5C each illustrate an example of the scanning path of the multiplexed light Lm on the reversible recording medium 100, and each pair of the irradiation start point and the irradiation end point is set as follows, for example.

In the scanning path illustrated in FIG. 5A, the first start point S1 and the first end point E1 are set at directly opposite positions to each other and the second start point S2 and the second end point E2 are set at directly opposite positions to each other in the main scanning direction of the multiplexed light Lm; and the first start point S1 and the second start point S2, and the first end point E1 and the second end point E2 are each set along the sub-scanning direction of the multiplexed light. According to this scanning path, for example, scanning with the multiplexed light Lm proceeds from the first start point S1 to the first end point E1 linearly in the main scanning direction, and thereafter, the irradiation with the multiplexed light Lm is brought into an off-state and the path is folded along, for example, a dotted line illustrated in 5A. Then, from the second start point S2 shifted in the sub-scanning direction, the irradiation is started and the scanning proceeds linearly in the main scanning direction to the second end point E2. This is repeated until the n-th end point En is reached.

According to the scanning path illustrated in FIG. 5B, the first start point S1 and the first end point E1 are set at directly opposite positions to each other and the second start point S2 and the second end point E2 are set at directly opposite positions to each other in the main scanning direction of the multiplexed light Lm; and the first start point S1 and the second end point E2, and the first end point E1 and the second start point S2 are each set along the sub-scanning direction of the multiplexed light. According to this scanning path, for example, scanning with the multiplexed light Lm proceeds from the first start point S1 to the first end point E1 linearly in the main scanning direction, and then shifts in the sub-scanning direction along, for example, a dotted line illustrated in 5B with the irradiation with the multiplexed light Lm brought into an off-state. Then, from the second start point S2, the irradiation is started and the scanning proceeds linearly in the main scanning direction to the second end point E2. This is repeated until the n-th end point En is reached.

Each pair of the irradiation start point and the irradiation end point does not necessarily have to be set at positions directly opposite to each other in the main scanning direction. For example, according to the scanning path illustrated in FIG. 5C, each end point is set at a position shifted from its corresponding start point in the sub-scanning direction. In this scanning path, the first start point S1, the first end point E1, the second start point S2, the second end point E2, . . . , the n-th start point Sn, and the n-th end point En are irradiated with the multiplexed light Lm consecutively in this order along the arrows. It is to be noted that as with FIGS. 5A and 5B described above, the irradiation with the multiplexed light Lm may be brought into an off-state after scanning with the multiplexed light Lm from the first start point S1 to the first end point E1 linearly in the main scanning direction, and then from the second start point S2, the irradiation may be started and the scanning may proceed linearly in the main scanning direction to the second end point E2.

Although FIGS. 5A to 5C illustrate examples in which the entire information written on the reversible recording medium 100 is erased collectively, it is also possible to selectively erase the drawing in any region. In a case where it is desired to erase the drawing in any region, for example, as illustrated in FIG. 6A, selectively irradiating the region where erasure is desired (a desired erasure region) with the multiplexed light Lm enables limited erasure of information. In this manner, by performing limited irradiation of the reversible recording medium 100 in the plane direction with the multiplexed light Lm, it is possible to reduce deformation of the reversible recording medium 100 such as warpage. Further, for example, by combining this partial erasure with the collective erasure from the reversible recording medium 100 described above, it is possible to reduce non-uniformity of erasure or the like. Furthermore, as illustrated in FIG. 6B, each of the point-to-point scanning paths from the first start point Si to the first end point E1, from the second start point S2 . . . to the n+1-th start point does not necessarily have to be linear. For example, a path Mal through which the multiplexed light Lm travels in a straight line in one direction and a path Ma2 through which the multiplexed light Lm travels in a straight line in a direction different from the one direction may be combined.

A spot diameter of the multiplexed light Lm for erasure is preferably larger than a spot diameter at the time of drawing, and is preferably, for example, 0.1 m square or more and not more than 3 mm square. An output of the multiplexed light Lm for erasure is preferably 3 W or more and not more than 30 W. A main scanning speed is preferably 1 msec or more and not more than 20 msec. A sub-scanning speed is preferably 5 mm/sec or less.

By combining the scanning path and scanning speed of the multiplexed light Lm for erasure and the spot diameter and output of the multiplexed light Lm for erasure described above, it is possible to finely adjust the amount of heat in the reversible recording medium 100 at or above the temperature level necessary for erasure, as illustrated in FIG. 4. This makes it possible to easily perform adjustments in response to minute changes such as variations in sensitivity of the recording layers 112M, 112C, and 112Y.

(1-5. Workigs and Effects)

As described above, a recording medium that enables information to be recorded and erased reversibly by heat, i.e., a so-called reversible recording medium, has been put into practical use as an example of a display medium that replaces a printed matter. For example, information is written and erased on and from the reversible recording medium by a drawing apparatus including a light source for writing and a light source for erasure. Further, on and from the reversible recording medium, information is written by a writing apparatus including a light source for writing, and information is erased by an erasing apparatus including a light source for erasure.

As an erasing apparatus for a reversible recording medium, various erasing apparatuses such as the image erasing apparatus described above have been developed. However, it is difficult to provide sufficient erasing performance on a reversible recording medium that enables multicolor display with a plurality of stacked recording layers developing colors different from each other, like the reversible recording medium 100A illustrated in FIG. 2, and there is an issue of degradation of display quality due to incomplete erasure of written information, a burn, or the like.

In contrast, in the drawing and erasing apparatus 1 and the erasing method of the present embodiment, overlapping scanning of a predetermined region on the reversible recording medium 100 is performed with the multiplexed light Lm obtained by multiplexing the plurality of types of laser light beams La, Lb, and Lc outputted from the plurality of laser elements (e.g., the light sources 31A, 31B, and 31C) different from each other in emission wavelength. This makes it possible to finely adjust the temperature level of the predetermined region of the reversible recording medium 100.

As described above, in the drawing and erasing apparatus 1 and the erasing method of the present embodiment, overlapping scanning is performed on the predetermined region on the reversible recording medium 100 with the multiplexed light Lm obtained by multiplexing the plurality of types of laser light beams La, Lb, and Lc outputted from the plurality of laser elements different from each other in emission wavelength. This suppresses an abrupt temperature rise or fall, and makes it possible to perform fine adjustments. Accordingly, it becomes possible to easily perform adjustments in response to minute changes such as variations in sensitivity of the recording layers 112M, 112C, and 112Y, thus reducing erasure defects and enabling improvement of the display quality.

Further, in the drawing and erasing apparatus 1 and the erasing method of the present embodiment, when erasure is performed, the lens 42 is added to the optical system of the multiplexer 40 to thereby adjust the beam shape of the multiplexed light Lm. This makes it possible to write and erase information on and from the reversible recording medium 100 in the same apparatus. It is thus possible to achieve size reduction of the apparatus that writes and erases information on and from the reversible recording medium 100. In addition, it becomes possible to reduce cost.

It is to be noted that the present embodiment illustrates an example in which the second layers 113B and 114B of the intermediate layers 113 and 114 provided respectively between the recording layer 112M and the recording layer 112C and between the recording layer 112C and the recording layer 112Y are formed using a material having a low Young's modulus; however, the present embodiment is not limited thereto. For example, the second layers 113B and 114B may be formed using a material higher in barrier property than the first layers 113A and 114A and the third layers 113C and 114C. This reduces diffusion of color developing molecules or the like, thus making it possible to reduce the occurrence of color mixing during drawing. Further, the second layers 113B and 114B may also be formed using a material higher in porosity than the first layers 113A and 114A and the third layers 113C and 114C. This reduces the propagation of heat generated during drawing on a desired recording layer (for example, the recording layer 112C) to the other recording layers (for example, the recording layers 112M and 112Y), thus making it possible to reduce the occurrence of color mixing during drawing. Further, the second layers 113B and 114B may also be formed using a material higher in thermal conductivity than the first layers 113A and 114A and the third layers 113C and 114C. This makes it easy for the heat generated during drawing on a desired recording layer (for example, the recording layer 112C) to propagate in the plane direction in the second layers 113B and 114B, and reduces its propagation in the stacking direction (to the other recording layers (for example, the recording layers 112M and 112Y)). Furthermore, the second layers 113B and 114B may also be formed using a material lower in curing shrinkage rate than the first layers 113A and 114A and the third layers 113C and 114C. This suppresses the generation of cracks due to residual stress caused by curing shrinkage occurring during drying of the intermediate layers, thus making it possible to reduce the generation of color mixing through cracks.

Next, a modification example of the present disclosure will be described. In the following, the components similar to those of the foregoing embodiment are denoted by the same reference numerals, and descriptions thereof are omitted as appropriate.

2. MODIFICATION EXAMPLE

FIG. 7 illustrates a cross-sectional configuration of a reversible recording medium (a reversible recording medium 100B) according to a modification example of the present disclosure. As in the foregoing embodiment, the reversible recording medium 100B is one in which a recording layer 162 that is reversibly changeable between a recording state and an erasing state is disposed on the support base 111, for example. The reversible recording medium 100B of the present modification example has a configuration in which the recording layer 162 containing, for example, three types of coloring compounds that are to exhibit colors different from each other is stacked with the intermediate layers 113 and 114 each having a configuration similar to that in the foregoing embodiment in between.

As described above, the recording layer 162 contains three types of coloring compounds that are to exhibit colors different from each other (e.g., a cyan color (C), a magenta color (M) and a yellow color (Y)). Specifically, the recording layer 162 is formed by, for example, preparing and mixing three types of microcapsules 162C, 162M, and 162Y that contain the respective coloring compounds to exhibit the cyan color (C), the magenta color (M), and the yellow color (Y), respective color developing/reducing agents corresponding to the coloring compounds, and respective photothermal conversion materials that absorb light rays in wavelength regions different from each other to generate heat. It is possible to form the recording layer 162 by, for example, dispersing the above-described microcapsules 162C, 162M, and 162Y in a polymeric material exemplified as a constituent material of the recording layer 112 in the above-described embodiment, for example, and applying the resultant onto the support base 111 with the intermediate layer formed thereon, for example.

As described above, the foregoing embodiment and modification examples 1 to 7 illustrate an example in which layers that exhibit colors different from each other (the recording layers 112M, 112C, and 112Y) are formed as the recording layers 112 and these layers are stacked with the intermediate layers (e.g., the intermediate layers 113 and 114) interposed therebetween. However, for example, by encapsulating coloring compounds that are to exhibit respective colors and materials corresponding to the respective coloring compounds into microcapsules and mixing them as in the present modification example, it is possible to provide a reversible recording medium that enables multicolor display even with a single-layer structure.

3. APPLICATION EXAMPLES

Next, description will be given of application examples of the reversible recording medium 100 (the reversible recording media 100A and 100B) described in the foregoing embodiment and modification example. However, configurations of electronic devices described below are mere examples, and the configurations may be varied appropriately. The foregoing reversible recording medium 100 is applicable to a portion of various electronic devices or clothing accessories. For example, as what is called a wearable terminal, it is possible to apply the reversible recording medium 100 to a portion of a clothing accessory such as a watch (wristwatch), a bag, clothing, a hat, a helmet, a headset, eyeglasses, or shoes, for example. Other examples include a wearable display such as a heads-up display or a head-mounted display, a portable device having portability such as a portable audio player or a handheld game console, a robot, or a refrigerator, a washing machine, etc., and the types of the electronic devices are not particularly limited. Furthermore, the reversible recording medium 100 is applicable not only to the electronic devices or clothing accessories but also to, as a decorating member, for example, an interior or exterior of an automobile, an interior or exterior of a wall or the like of a building, an exterior of furniture such as a desk, or the like.

Application Example 1

FIGS. 8A and 8B each illustrate an appearance of an integrated circuit (IC) card with a rewritable function. The IC card has a card surface serving as a printing surface 210, and is configured by, for example, bonding thereto a sheet-shaped reversible recording medium 100 or the like. The IC card allows for drawing on the printing surface and also rewriting and erasing thereof appropriately by disposing the reversible recording medium 100 or the like on the printing surface 210, as illustrated in FIGS. 11A and 11B.

Application Example 2

FIG. 9A illustrates an appearance configuration of a front surface of a smartphone, and FIG. 9B illustrates an appearance configuration of a rear surface of the smartphone illustrated in FIG. 9A. This smartphone includes, for example, a display section 310, a non-display section 320, and a housing 330. For example, in a surface of the housing 330 on the rear surface side, the reversible recording medium 100 or the like, for example, is provided as an exterior member of the housing 330, and this makes it possible to display various colors and patterns as illustrated in FIG. 9B. It is to be noted that although a smartphone is taken as an example here, the reversible recording medium 100 is applicable not only to this but also to, for example, a laptop personal computer (PC), a tablet PC, or the like.

Application Example 3

FIGS. 10A and 10B each illustrate an appearance of a bag. The bag includes, for example, a storing part 410 and a handle 420, and the reversible recording medium 100, for example, is attached to the storing part 410, for example. Various characters and patterns are displayed on the storing part 410 by the reversible recording medium 100, for example. Furthermore, attaching the reversible recording medium 100 or the like to a portion of the handle 420 makes it possible to display various color patterns and makes it possible to change the design of the storing part 410, like from the example of FIG. 10A to the example of FIG. 10B. It is thus possible to provide an electronic device that is useful also for a fashion purpose.

Application Example 4

FIG. 11 illustrates a configuration example of a wristband that is able to record, for example, in an amusement park, attraction-riding history, schedule information and the like, for example. The wristband includes belt parts 51115112 and an information recording layer 520. The belt parts 51115112 have a band shape, for example, and respective ends (unillustrated) thereof are configured to be coupled to each other. The reversible recording medium 100 or the like, for example, is bonded to the information recording layer 520, and an information code CD, for example, as well as attraction-riding history MH2 and schedule information IS (IS1 to IS3) described above, is recorded thereon. In the amusement park, a visitor is able to record the above-described information by waving the wristband over a drawing apparatus installed at various locations such as attraction-riding reservation spots.

A riding history mark MH1 indicates the number of attractions ridden by a visitor who wears the wristband in the amusement park. In this example, the more attractions the visitor rides, the more star-shaped marks are recorded as the riding history mark MH1. It is to be noted that this is not limitative and, for example, the color of the mark may be changed in accordance with the number of attractions ridden by the visitor.

The schedule information IS in this example indicates a schedule of the visitor. In this example, information about all of events including an event reserved by the visitor and events to be held in the amusement park is recorded as the schedule information IS1 to IS3. Specifically, in this example, a title of an attraction (an attraction 201) of which riding is reserved by the visitor and the scheduled time of the riding are recorded as the schedule information IS1. Further, an event such as a parade in the park and its scheduled starting time are recorded as the schedule information IS2. Furthermore, a restaurant reserved by the visitor in advance and its scheduled mealtime are recorded as the schedule information IS3.

The information code CD records, for example, identification information IID that is used to identify the wristband and website information IWS.

Application Example 5

FIG. 115A illustrates an appearance of an upper surface of an automobile, and FIG. 115B illustrates an appearance of a side surface of the automobile. Providing the reversible recording medium 100 or the like of the present disclosure on the automobile body parts such as a bonnet 511, a bumper 5112, a roof 5113, a boot lid 5114, a front door 5115, a rear door 516, or a rear bumper 517, for example, makes it possible to display various information or colors and patterns on each part. In addition, providing the reversible recording medium 100 or the like on an interior of the automobile such as a steering wheel or dashboard, for example, makes it possible to display various colors and patterns thereon.

Application Example 6

FIG. 13 illustrates an appearance of a cosmetic case. The cosmetic case includes, for example, a receiving section 710, and a lid 720 to cover the receiving section 710. For example, the reversible recording medium 100 is bonded to the lid 720, for example. The reversible recording medium 100 allows the lid 720 to be decorated with patterns, color patterns, characters or the like as illustrated in FIG. 13, for example. The patterns, color patterns, characters or the like on the lid 720 are rewritable and erasable by the drawing and erasing apparatus 1 installed in the shop, for example.

4. EXAMPLES

Next, Examples of the drawing and erasing apparatus 1 according to the present embodiment will be described.

First, a reversible recording medium including recording layers on a support base was produced, the recording layers developing cyan (C), magenta (M), yellow (Y), and black (K). Table 1 lists L*a*b* values of the produced reversible recording medium before drawing. Table 2 summarizes the reflection density (OD) of each recording layer after writing. The foregoing reversible recording medium after drawing was scanned with multiplexed light that was obtained by multiplexing three types of laser light beams (laser C, laser M, and laser Y) and that was adjusted to a beam size (FWHM; full width at half maximum) having a main scanning width of 0.901 mm and a sub-scanning width of 0.699 mm under irradiation conditions described below.

TABLE 1

| L*, a*, and b* before drawing | | |
|---|---|---|
| L* | a* | b* |
| 70.21 | −1.31 | 3.66 |

TABLE 2

| Drawing OD | | | |
|---|---|---|---|
| C | M | Y | K |
| 1.55 | 1.55 | 1.05 | 1.7 |

Experimental Example 1

In Experimental Example 1, scanning was performed with the multiplexed light (6.7 W in total) of the laser C having an output of 2.34 W, the laser M having an output of 1.66 W, and the laser Y having an output of 2.7 W at a main scanning speed of 7 msec and a sub-scanning speed of 0.58 mm/sec to erase a solid image written on the reversible recording medium, and the reflection density after erasure was measured.

Experimental Example 2

In Experimental Example 2, scanning was performed with the multiplexed light (6.7 W in total) of the laser C having an output of 2.34 W, the laser M having an output of 1.66 W, and the laser Y having an output of 2.7 W at a main scanning speed of 7 msec and a sub-scanning speed of 0.63 mm/sec to erase a solid image written on the reversible recording medium, and the reflection density after erasure was measured.

Experimental Example 3

In Experimental Example 3, scanning was performed with the multiplexed light (6.7 W in total) of the laser C having an output of 2.34 W, the laser M having an output of 1.66 W, and the laser Y having an output of 2.7 W at a main scanning speed of 7 msec and a sub-scanning speed of 0.68 mm/sec to erase a solid image written on the reversible recording medium, and the reflection density after erasure was measured.

Experimental Example 4

In Experimental Example 4, scanning was performed with the multiplexed light (6.7 W in total) of the laser C having an output of 2.34 W, the laser M having an output of 1.66 W, and the laser Y having an output of 2.7 W at a main scanning speed of 7 msec and a sub-scanning speed of 0.73 mm/sec to erase a solid image written on the reversible recording medium, and the reflection density after erasure was measured.

Experimental Example 5

In Experimental Example 5, scanning was performed with the multiplexed light (6.7 W in total) of the laser C having an output of 2.34 W, the laser M having an output of 1.66 W, and the laser Y having an output of 2.7 W at a main scanning speed of 7 msec and a sub-scanning speed of 0.78 mm/sec to erase a solid image written on the reversible recording medium, and the reflection density after erasure was measured.

Experimental Example 6

In Experimental Example 6, scanning was performed with the multiplexed light (5.7 W in total) of the laser C having an output of 2 W, the laser M having an output of 1.4 W, and the laser Y having an output of 2.3 W at a main scanning speed of 7 msec and a sub-scanning speed of 0.88 mm/sec to erase a solid image written on the reversible recording medium, and the reflection density after erasure was measured.

Experimental Example 7

In Experimental Example 7, scanning was performed with the multiplexed light (6.3 W in total) of the laser C having an output of 2.23 W, the laser M having an output of 1.52 W, and the laser Y having an output of 2.55 W at a main scanning speed of 7 msec and a sub-scanning speed of 0.68 mm/sec to erase a solid image written on the reversible recording medium, and the reflection density after erasure was measured.

Experimental Example 8

In Experimental Example 8, scanning was performed with the multiplexed light (6.7 W in total) of the laser C having an output of 2.34 W, the laser M having an output of 1.66 W, and the laser Y having an output of 2.7 W at a main scanning speed of 7 msec and a sub-scanning speed of 0.68 mm/sec to erase a solid image written on the reversible recording medium, and the reflection density after erasure was measured.

Experimental Example 9

In Experimental Example 9, scanning was performed with the multiplexed light (7 Win total) of the laser C having an output of 2.34 W, the laser M having an output of 1.76 W, and the laser Y having an output of 2.9 W at a main scanning speed of 7 msec and a sub-scanning speed of 0.68 mm/sec to erase a solid image written on the reversible recording medium, and the reflection density after erasure was measured.

Experimental Example 10

In Experimental Example 10, scanning was performed with the multiplexed light (7.3 W in total) of the laser C having an output of 2.34 W, the laser M having an output of 1.76 W, and the laser Y having an output of 3.2 W at a main scanning speed of 7 msec and a sub-scanning speed of 0.68 mm/sec to erase a solid image written on the reversible recording medium, and the reflection density after erasure was measured.

Experimental Example 11

In Experimental Example 11, scanning was performed with the multiplexed light (7.6 W in total) of the laser C having an output of 2.34 W, the laser M having an output of 1.76 W, and the laser Y having an output of 3.5 W at a main scanning speed of 7 msec and a sub-scanning speed of 0.68 mm/sec to erase a solid image written on the reversible recording medium, and the reflection density after erasure was measured.

Experimental Example 12

In Experimental Example 12, scanning was performed with the multiplexed light (8 Win total) of the laser C having an output of 2.34 W, the laser M having an output of 2.2 W, and the laser Y having an output of 3.46 W at a main scanning speed of 7 msec and a sub-scanning speed of 1.00 mm/sec to erase a solid image written on the reversible recording medium, and the reflection density after erasure was measured.

Experimental Example 13

In Experimental Example 13, scanning was performed with the multiplexed light (10 W in total) of the laser C having an output of 2.34 W, the laser M having an output of 4.16 W, and the laser Y having an output of 3.5 W at a main scanning speed of 7 msec and a sub-scanning speed of 1.30 mm/sec to erase a solid image written on the reversible recording medium, and the reflection density after erasure was measured.

Experimental Example 14

In Experimental Example 14, scanning was performed with the multiplexed light (8 Win total) of the laser C having an output of 2.34 W, the laser M having an output of 2.2 W, and the laser Y having an output of 3.46 W at a main scanning speed of 7 msec and a sub-scanning speed of 1.30 mm/sec to erase a solid image written on the reversible recording medium, and the reflection density after erasure was measured.

For each of Experimental Examples 1 to 14, a color difference ΔE* between after erasure and before drawing was calculated. Examples of a method of expressing a color of an object by quantification include a CIE L*a*b* display system. L* denotes lightness, and a*b* denotes chromaticity indicating hue and chroma. a*b* indicates a direction of a color; a* indicates a red direction, −a* indicates a green direction, b* indicates a yellow direction, and −b* indicates a blue direction. As L* becomes larger, a color becomes more vivid. As a numerical value becomes smaller, a color becomes more somber. For example, in a case where a certain color 0 is expressed by ($L_0$*$a_0$*$b_0$*) and where a certain color 1 is expressed by ($L_1$*$a_1$*$b_1$*), it is possible to calculate a color difference ΔE* between the two colors by the following equations.

$$\Delta L^* = (L_0^* - L_1^*)$$

$$\Delta a^* = (a_0^* - a_1^*)$$

$$\Delta b^* = (b_0^* - b_1^*)$$

$$\Delta E^* = (\Delta L^{*2} + \Delta a^{*2} + \Delta b^{*2})^{0.5}$$

TABLE 3

| | Laser | | | | Beam size FWHM (full width at half) maximum) | | Speed | | ΔE (after erasure and before drawing) | | | |
|---|---|---|---|---|---|---|---|---|---|---|---|---|
| | C (W) | M (W) | Y (W) | Total (W) | Main scanning width (mm) | Sub-scanning width (mm) | Main scanning (m/sec) | Sub-scanning (mm/sec) | C | M | Y | K |
| Experimental Example 1-1 | 2.34 | 1.66 | 2.7 | 6.7 | 0.901 | 0.699 | 7 | 0.58 | 5.1 | 4.5 | 4.8 | 4.3 |
| Experimental Example 1-2 | 2.34 | 1.66 | 2.7 | 6.7 | 0.901 | 0.699 | 7 | 0.63 | 2.9 | 2.5 | 3.7 | 2.3 |
| Experimental Example 1-3 | 2.34 | 1.66 | 2.7 | 6.7 | 0.901 | 0.699 | 7 | 0.68 | 1.5 | 2.1 | 3.7 | 2.3 |
| Experimental Example 1-4 | 2.34 | 1.66 | 2.7 | 6.7 | 0.901 | 0.699 | 7 | 0.73 | 1.2 | 2.6 | 3.7 | 2.4 |
| Experimental Example 1-5 | 2.34 | 1.66 | 2.7 | 6.7 | 0.901 | 0.699 | 7 | 0.78 | 0.5 | 3.5 | 5.6 | 3.5 |

TABLE 3-continued

| | Laser | | | | Beam size FWHM (full width at half) maximum) | | Speed | | ΔE (after erasure and before drawing) | | | |
|---|---|---|---|---|---|---|---|---|---|---|---|---|
| | C (W) | M (W) | Y (W) | Total (W) | Main scanning width (mm) | Sub-scanning width (mm) | Main scanning (m/sec) | Sub-scanning (mm/sec) | C | M | Y | K |
| Experimental Example 1-6 | 2 | 1.4 | 2.3 | 5.7 | 0.901 | 0.699 | 7 | 0.68 | 2.0 | 6.0 | 9.1 | 5.3 |
| Experimental Example 1-7 | 2.23 | 1.52 | 2.55 | 6.3 | 0.901 | 0.699 | 7 | 0.68 | 1.0 | 3.1 | 4.1 | 2.8 |
| Experimental Example 1-8 | 2.34 | 1.66 | 2.7 | 6.7 | 0.901 | 0.699 | 7 | 0.68 | 1.5 | 2.1 | 3.2 | 2.1 |
| Experimental Example 1-9 | 2.34 | 1.76 | 2.9 | 7 | 0.901 | 0.699 | 7 | 0.68 | 2.3 | 2.2 | 3.4 | 2.3 |
| Experimental Example 1-10 | 2.34 | 1.76 | 3.2 | 7.3 | 0.901 | 0.699 | 7 | 0.68 | 3.1 | 2.5 | 3.5 | 2.7 |
| Experimental Example 1-11 | 2.34 | 1.76 | 3.5 | 7.6 | 0.901 | 0.699 | 7 | 0.68 | 5.1 | 4.0 | 4.3 | 3.9 |
| Experimental Example 1-12 | 2.34 | 2.2 | 3.46 | 8 | 0.901 | 0.699 | 7 | 1.00 | 2.2 | 2.2 | 2.3 | 2.8 |
| Experimental Example 1-13 | 2.34 | 4.16 | 3.5 | 10 | 0.901 | 0.699 | 7 | 1.30 | 1.7 | 2.7 | 2.1 | 2.7 |
| Experimental Example 1-14 | 2.34 | 2.2 | 3.46 | 8 | 0.901 | 0.699 | 7 | 1.30 | 3.8 | 6.2 | 3.7 | 6.3 |

Table 3 summarizes the erasure conditions and the color differences ΔE* between after erasure and before drawing for Experimental Examples 1 to 14. It was found that in general, if the color difference ΔE*≤3.2, the color difference was hardly recognized.

The present disclosure has been described with reference to the embodiment, the modification example, and Examples; however, the present disclosure is not limited to the implementations described in the foregoing embodiment, etc. and may be modified in a variety of ways. For example, it is not necessary that all of the components described in the foregoing embodiment, etc., be included, or any other component may further be included. Moreover, the materials and the thicknesses of the above-described components are mere examples, and are not limited to those described herein.

Further, although the foregoing modification example illustrates an example in which the microcapsules are used to perform multicolor display with a single-layer structure, this is not limitative; for example, it is also possible to use a fiber-shaped three-dimensional stereoscopic structure to perform the multicolor display. For example, the fiber to be used here preferably has a so-called core-sheath structure configured by a core part containing a coloring compound that is to exhibit a desired color, a color developing/reducing agent corresponding thereto, and a photothermal conversion material, and by a sheath part that coats the core part and is configured by a heat insulating material. By forming the three-dimensional stereoscopic structure using a plurality of types of fibers having the core-sheath structure and containing coloring compounds that are to exhibit colors different from each other, it becomes possible to fabricate a reversible recording medium that enables multicolor display.

Further, the foregoing embodiment illustrates an example in which the recording layer 112 (in FIG. 2, the recording layer 112M) is provided directly on the support base 111; however, for example, a layer having a configuration similar to that of the intermediate layer 113 may be additionally provided between the support base 111 and the recording layer 112M.

It is to be noted that the effects described herein are merely exemplary and are non-limiting, and other effects may be achieved.

Note that the present disclosure may have the following configurations.

(1)

A drawing and erasing apparatus including:

a light source section that includes a plurality of laser elements different from each other in emission wavelength;

a multiplexer that multiplexes a plurality of types of laser light beams outputted from the plurality of laser elements;

a scanner section that performs scanning with multiplexed light outputted from the multiplexer on a reversible recording medium including a plurality of recording layers, the plurality of recording layers being reversible and different from each other in developed color hue; and a controller that controls a main scanning speed and a sub-scanning speed of the scanner section to cause the scanner section to perform overlapping scanning of a predetermined region on the reversible recording medium during erasure of information written on the reversible recording medium.

(2)

The drawing and erasing apparatus according to (1), further including a switching section that switches an optical system constituting the multiplexer when drawing to write information on the reversible recording medium is performed and when the erasure is performed.

(3)

The drawing and erasing apparatus according to (2), in which the multiplexer includes an optical lens that adjusts a spot diameter of the multiplexed light, and the switching section mounts/dismounts the optical lens to/from the optical system of the multiplexer when the drawing is performed and when the erasure is performed.

(4)

The drawing and erasing apparatus according to any one of (1) to (3), in which the main scanning speed is 1 m/sec or more and not more than 20 m/sec.

(5)

The drawing and erasing apparatus according to any one of (1) to (4), in which the sub-scanning speed is 5 m/sec or less.

(6)

The drawing and erasing apparatus according to any one of (2) to (5), in which a spot diameter of the multiplexed light when the erasure is performed is smaller than a spot diameter of a laser light beam that is used when the drawing is performed.

(7)

The drawing and erasing apparatus according to any one of (1) to (6), in which a spot diameter of the multiplexed light when the erasure is performed is 0.1 mm square or more and not more than 3 mm square.

(8)

The drawing and erasing apparatus according to any one of (1) to (7), in which an output of the multiplexed light when the erasure is performed is 3 W or more and not more than 30 W.

(9)

The drawing and erasing apparatus according to any one of (1) to (8), in which the reversible recording medium includes the plurality of recording layers containing reversible thermal color developing compositions and photothermal conversion materials, color hues to be developed by the reversible thermal color developing compositions are different between the plurality of recording layers, and absorption wavelengths of the photothermal conversion materials are different between the plurality of recording layers.

(10)

An erasing method including:

multiplexing laser light beams outputted from a plurality of laser elements different from each other in emission wavelength; and performing, with multiplexed light, overlapping scanning of a predetermined region on a reversible recording medium including a plurality of recording layers, the plurality of recording layers being reversible and different from each other in developed color hue.

(11)

The erasing method according to (10), in which a scanning path of the multiplexed light includes a first start point, a first end point, a second start point, and a second end point arranged across the predetermined region of the reversible recording medium.

(12)

The erasing method according to (11), in which the first start point, the first end point, the second start point, and the second end point are irradiated with the multiplexed light consecutively in this order.

(13)

The erasing method according to any one of (10) to (12), in which the scanning includes discontinuous irradiation of the predetermined region of the reversible recording medium with the multiplexed light.

(14)

The erasing method according to (13), in which a scanning path of the multiplexed light includes a first start point, a first end point, a second start point, and a second end point arranged across the predetermined region of the reversible recording medium, and after scanning from the first start point to the first end point, scanning from the first end point to the second start point is performed without irradiation with the multiplexed light.

(15)

The erasing method according to any one of (11) to (14), in which the first start point and the first end point are arranged at directly opposite positions to each other and the second start point and the second end point are arranged at directly opposite positions to each other in a main scanning direction of the multiplexed light (an X-axis direction), and the first start point and the second start point, and the first end point and the second end point are each arranged along a sub-scanning direction of the multiplexed light (a Y-axis direction).

(16)

The erasing method according to any one of (11) to (14), in which the first start point and the first end point are arranged at directly opposite positions to each other and the second start point and the second end point are arranged at directly opposite positions to each other in a main scanning direction of the multiplexed light (an X-axis direction), and the first start point and the second end point, and the first end point and the second start point are each arranged along a sub-scanning direction of the multiplexed light (a Y-axis direction).

(17)

The erasing method according to any one of (11) to (14), in which the first start point and the second start point, and the first end point and the second end point are each arranged along a sub-scanning direction of the multiplexed light (a Y-axis direction), and the first end point and the second end point are arranged at positions that are shifted from the first start point and the second start point, respectively, in the sub-scanning direction.

This application claims priority from Japanese Patent Application No. 2018-118966 filed on Jun. 22, 2018 with the Japan Patent Office, the entire contents of which are incorporated in the present application by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A drawing and erasing apparatus comprising:

a light source section that includes a plurality of laser elements different from each other in emission wavelengths;

a multiplexer that multiplexes a plurality of types of laser light beams outputted from the plurality of laser elements;

a scanner section that performs scanning with multiplexed light outputted from the multiplexer on a reversible recording medium including a plurality of recording layers, the plurality of recording layers being reversible and different from each other in developed color hues;

a controller that controls a main scanning speed and a sub-scanning speed of the scanner section to cause the scanner section to perform overlapping scanning of a predetermined region on the reversible recording medium during erasure of information written on the reversible recording medium; and a switching section that switches an optical system constituting the multiplexer when drawing to write information on the reversible recording medium is performed and when the erasure is performed.

2. The drawing and erasing apparatus according to claim 1, wherein the multiplexer includes an optical lens that adjusts a spot diameter of the multiplexed light, and the switching section mounts/dismounts the optical lens to/from the optical system of the multiplexer when the drawing is performed and when the erasure is performed.

3. The drawing and erasing apparatus according to claim 1, wherein the main scanning speed is 1 m/sec or more and not more than 20 m/sec.

4. The drawing and erasing apparatus according to claim 1, wherein the sub-scanning speed is 5 m/sec or less.

5. The drawing and erasing apparatus according to claim 1, wherein a spot diameter of the multiplexed light when the erasure is performed is smaller than a spot diameter of a laser light beam that is used when the drawing is performed.

6. The drawing and erasing apparatus according to claim 1, wherein a spot diameter of the multiplexed light when the erasure is performed is 0.1 $mm^2$ or more and not more than 3 $mm^2$ .

7. The drawing and erasing apparatus according to claim 1, wherein an output of the multiplexed light when the erasure is performed is 3 W or more and not more than 30 W.

8. The drawing and erasing apparatus according to claim 1, wherein the reversible recording medium includes the plurality of recording layers containing reversible thermal color developing compositions and photothermal conversion materials, color hues to be developed by the reversible thermal color developing compositions are different between the plurality of recording layers, and absorption wavelengths of the photothermal conversion materials are different between the plurality of recording layers.

9. An erasing method comprising:

multiplexing laser light beams outputted from a plurality of laser elements different from each other in emission wavelengths; and performing, with multiplexed light, overlapping scanning of a predetermined region on a reversible recording medium including a plurality of recording layers, the plurality of recording layers being reversible and different from each other in developed color hues; and switching, by a switching section, an optical system constituting the multiplexer when drawing to write information on the reversible recording medium is performed and when erasure is performed.

10. The erasing method according to claim 9, wherein a scanning path of the multiplexed light includes a first start point, a first end point, a second start point, and a second end point arranged across the predetermined region of the reversible recording medium.

11. The erasing method according to claim 10, where in the first start point, the first end point, the second start point, and the second end point are irradiated with the multiplexed light consecutively in this order.

12. The erasing method according to claim 10, wherein the first start point and the first end point are arranged at directly opposite positions to each other and the second start point and the second end point are arranged at directly opposite positions to each other in a main scanning direction of the multiplexed light, and the first start point and the second start point, and the first end point and the second end point are arranged along a sub-scanning direction of the multiplexed light.

13. The erasing method according to claim 11, wherein the first start point and the first end point are arranged at directly opposite positions to each other and the second start point and the second end point are arranged at directly opposite positions to each other in a main scanning direction of the multiplexed light, and the first start point and the second end point, and the first end point and the second start point are each arranged along a sub-scanning direction of the multiplexed light.

14. The erasing method according to claim 11, wherein the first start point and the second start point, and the first end point and the second end point are each arranged along a sub-scanning direction of the multiplexed light, and the first end point and the second end point are arranged at positions that are shifted from the first start point and the second start point, retrospectively, in the sub-scanning direction.

15. The erasing method according to claim 9, wherein the scanning includes discontinuous irradiation of the predetermined region of the reversible recording medium with the multiplexed light.

16. The erasing method according to claim 15, wherein a scanning path of the multiplexed light includes a first start point, a first end point, a second start point, and a second end point arranged across the predetermined region of the reversible recording medium, and after scanning from the first start point to the first end point, scanning from the first end point to the second start point is performed without irradiation with the multiplexed light.

* * * * *